US011001772B2

(12) United States Patent
Bafna et al.

(10) Patent No.: US 11,001,772 B2
(45) Date of Patent: May 11, 2021

(54) PROCESS FOR PRODUCING OLEFINS USING AROMATIC SATURATION

(71) Applicant: Sabic Global Technologies B.V., Bergen op Zoom (NL)

(72) Inventors: Sheetal Bafna, Sugar Land, TX (US); Jose Armando Salazar-Guillen, Sugar Land, TX (US); Sanjeev Deshpande, Sugar Land, TX (US); Scott Stevenson, Sugar Land, TX (US); Michael Huckman, Sugar Land, TX (US); Joseph W. Schroer, Sugar Land, TX (US)

(73) Assignee: SABIC GLOBAL TECHNOLOGIES B.V., Bergen op Zoom (NL)

( * ) Notice: Subject to any disclaimer, the term of this patent is extended or adjusted under 35 U.S.C. 154(b) by 0 days.

(21) Appl. No.: 16/080,205

(22) PCT Filed: Feb. 9, 2017

(86) PCT No.: PCT/US2017/017101

§ 371 (c)(1),
(2) Date: Aug. 27, 2018

(87) PCT Pub. No.: WO2017/151283

PCT Pub. Date: Sep. 8, 2017

(65) Prior Publication Data

US 2019/0055483 A1 Feb. 21, 2019

Related U.S. Application Data

(60) Provisional application No. 62/301,139, filed on Feb. 29, 2016.

(51) Int. Cl.
*C10G 69/06* (2006.01)
*C10G 67/00* (2006.01)

(52) U.S. Cl.
CPC ..... *C10G 69/06* (2013.01); *C10G 67/00* (2013.01); *C10G 2300/1011* (2013.01);
(Continued)

(58) Field of Classification Search
None
See application file for complete search history.

(56) References Cited

U.S. PATENT DOCUMENTS 6,900,365 B2 5/2005 Chen et al.
8,940,950 B2 1/2015 Ellrich et al.
(Continued)

FOREIGN PATENT DOCUMENTS

WO WO 2006/063201 6/2006
WO WO 2015/076941 5/2015

OTHER PUBLICATIONS

Castano et al., "Aromatics reduction of pyrolysis gasoline (PyGas) over HY-supported transition metal catalysts" *Applied Catalysis A: General*, 2006, 315:101-113.
(Continued)

*Primary Examiner* — Tam M Nguyen
(74) *Attorney, Agent, or Firm* — Norton Rose Fulbright US LLP

(57) ABSTRACT

A process for increasing olefin production from refinery that processes hydrocarbon streams that are rich in aromatic compounds and includes steam cracking and hydrotreating an aromatically rich feedstock to produce a hydrotreated pyrolysis gasoline stream and light pyrolysis oil byproduct, saturating at least one additional naphtha/hydrocarbon stream together with the hydrotreated pyrolysis gasoline stream or together with the light pyrolysis oil byproducts to form a first naphthene stream, and steam cracking the first naphthene stream to produce olefins.

9 Claims, 5 Drawing Sheets

(52) U.S. Cl.
CPC ..... *C10G 2300/1096* (2013.01); *C10G 2300/4081* (2013.01); *C10G 2400/02* (2013.01); *C10G 2400/20* (2013.01); *C10G 2400/30* (2013.01)

(56) References Cited

U.S. PATENT DOCUMENTS

| | | | | |
|---|---|---|---|---|
| 8,962,900 | B2 | 2/2015 | Kim et al. | |
| 8,975,462 | B2 | 3/2015 | Kim et al. | |
| 2010/0087692 | A1 | 4/2010 | Yoshimura et al. | |
| 2010/0160699 | A1 | 6/2010 | Frey et al. | |
| 2011/0277376 | A1* | 11/2011 | Bloom | C10G 33/00 44/403 |
| 2015/0175909 | A1* | 6/2015 | Van Doesburg | C10G 65/043 208/89 |
| 2016/0102258 | A1* | 4/2016 | Kumar | C10G 65/00 208/57 |
| 2019/0055483 | A1* | 2/2019 | Bafna | C10G 67/00 |

OTHER PUBLICATIONS

Ringelhan et al. "Conversion of naphthenes to a high value steamcracker feedstock using H-ZSM-5 based catalysts in the second step of the ARINO® -process" *Catalysis Today*, 2004, 97:277-282.

International Search Report and Written Opinion issued in International Patent Application No. PCT/US2017/017101, dated Aug. 2, 2017.

* cited by examiner

PROCESS FOR PRODUCING OLEFINS USING AROMATIC SATURATION

CROSS REFERENCE TO RELATED APPLICATIONS

This application is a filing under 35 U.S.C. 371 of International Application No. PCT/US2017/017101 filed Feb. 9, 2017, entitled, "A Process for Producing Olefins Using Aromatic Saturation," which claims the benefit of U.S. Provisional Application No. 62/301,139 filed Feb. 29, 2016, entitled "A Process for Producing Olefins Using Aromatic Saturation," which are incorporated by referenced herein in their entirety.

TECHNICAL FIELD

The present disclosure relates to a process for increasing olefin production from hydrocarbon streams that are rich in aromatic compounds.

BACKGROUND OF THE INVENTION

Petrochemical/refinery processes are limited by their inability to scale olefin and aromatic production from naphtha rich feedstocks. Demand for olefins, such as butadiene, propylene, and ethylene, has steadily increased over the last few years [see, Ladwig, U.S. Pat. No. 6,339,180B1, incorporated herein by reference in its entirety]. However, olefin production is often sacrificed in favor of increased production of valuable aromatics such as benzene ($C_6$), toluene ($C_7$), and xylenes ($C_8$). This discourages the hydrogenation of aromatics to form naphthenes which are often used as feedstocks en route to olefins [see, Kim et al., U.S. Pat. No. 8,962,900B2, incorporated herein by reference in its entirety].

This trend has limited the possibility of improvement in olefin yields. Currently, low value byproducts, such as light pyrolysis oil separated during the hydrotreating pyrolysis gasoline), are either subject to refining steps such as transalkylation, dealkylation and/or isomerization to increase the yield of valuable aromatics when needed, or relegated to fuel oil pools [see, Ellrich et al., U.S. Pat. No. 8,940,950B2, incorporated herein by reference in its entirety]. This emphasis of aromatic production over olefin production poses a distinct challenge for global petrochemical producers looking to take advantage of these related product line markets.

Variances in sulfur, aromatic and naphthenic contents of hydrocarbon feedstocks from region to region also necessitate more dynamic processes in olefin production. For example, Chinese, African and Middle Eastern refineries yield feedstocks with higher aromatic and lower naphthene contents when compared to North American "sweet crude" feedstocks [see, Hamad et al., US201180253595A1, incorporated herein by reference in its entirety]. As a result, demand for olefin products is higher in these regions. However, existing methods of olefin production remain incapable of adjusting to meet these needs.

Attempts to resolve this continual processing limitation have been few. Attempts to accommodate different feedstocks in processes that include more than one cracking unit [see, Tallman et al., U.S. Pat. No. 7,128,827B2, incorporated herein by reference in its entirety] have failed to boost olefin production as have attempts to use other methods such as hydrotreating byproduct streams [see, Kim et al., U.S. Pat. No. 8,962,900B2, incorporated herein by reference in its entirety]. Unfortunately both solutions require increased production costs, only partially convert byproducts, provide limited olefin gains and fail to address coking, catalyst deactivation and contamination of active components from "recycled" byproducts.

In view of the forgoing an objective of the present disclosure is to provide an integrated process for increasing olefin production from aromatically rich hydrocarbon streams and byproducts alongside valuable aromatic production.

BRIEF SUMMARY OF THE INVENTION

According to a first aspect, the present disclosure relates to a process for producing an olefin stream from a steam-cracked hydrocarbon stream, comprising i) steam cracking a hydrocarbon stream to form a steam-cracked hydrocarbon stream and a heavy pyrolysis oil stream, wherein the steam-cracked hydrocarbon stream comprises at least one of butadiene, ethylene, propylene, and/or any combinations thereof, ii) separating the steam-cracked hydrocarbon stream to form an olefin rich stream and a raw pyrolysis gasoline stream, iii) hydrotreating the raw pyrolysis gasoline stream to form a first hydrotreated pyrolysis gasoline stream, iv) saturating the first hydrotreated pyrolysis gasoline stream together with at least one additional naphtha/hydrocarbon stream to form a first naphthene stream and, v) flowing the first naphthene stream to the steam cracking to form olefins.

In various embodiments, the first hydrotreated pyrolysis gasoline stream comprises $C_{5+}$ compounds.

In various embodiments, the first hydrotreated pyrolysis gasoline stream comprises 40-60% by weight of aromatic compounds.

In various embodiments, a portion of the first hydrotreated pyrolysis gasoline stream is subject to transalkylating or dealkylating prior to the saturating to form the first naphthene stream.

In various embodiments, the hydrotreating removes at least one of a nitrogen containing contaminant, a sulfur containing contaminant, or both from the raw pyrolysis gasoline stream.

In various embodiments, the at least one additional naphtha/hydrocarbon stream is a hydrotreated residue fluid catalytic cracking heavy naphtha stream comprising mainly $C_{7+}$ compounds.

In various embodiments, the hydrotreated residue fluid catalytic cracking (RFCC) heavy naphtha stream comprises 20-80% by weight of aromatic compounds.

In various embodiments, the at least one additional naphtha/hydrocarbon stream is a hydrocracked LCO naphtha comprising $C_{7+}$ compounds.

In various embodiments, the hydrocracked LCO naphtha comprises by weight at least 25% aromatic compounds.

In various embodiments, the saturating comprises hydrogenating the unsaturated compounds present in the first hydrotreated pyrolysis gasoline stream and the additional naphtha/hydrocarbon stream in the presence of a catalyst.

In various embodiments, both the first hydrotreated pyrolysis gasoline stream and the at least one additional naphtha/hydrocarbon stream comprise aromatic compounds and the saturating converts at least 90% of the aromatic compounds to form naphthenes.

In various embodiments, prior to the saturating the first hydrotreated pyrolysis gasoline stream is processed to saturate one or more dicyclopentadiene compounds present therein.

In various embodiments, the process further comprises splitting the first hydrotreated pyrolysis gasoline stream into a $C_{5-}$ stream and a $C_{6+}$ stream saturating the $C_{6+}$ stream optionally together with the at least one additional naphtha/hydrocarbon stream to form a second naphthene stream, steam cracking the second naphthene stream to form an olefin stream, and recycling the $C_{5-}$ stream to the steam cracking.

In various embodiments, the $C_{6+}$ stream comprises at least 40% by weight of aromatic compounds.

In various embodiments, at least 40% by weight of the first naphthene stream is cracked to form olefins during the steam cracking.

According to a second aspect, the present disclosure relates to a process for producing an olefin stream from a steam-cracked hydrocarbon stream, comprising i) steam cracking a hydrocarbon stream to form a steam-cracked hydrocarbon stream and a heavy pyrolysis oil stream, wherein the steam-cracked hydrocarbon stream comprises at least one of butadiene, ethylene, propylene, and/or combinations thereof, ii) separating the steam-cracked hydrocarbon stream to form a raw pyrolysis gasoline stream and an olefin rich stream, iii) hydrotreating the raw pyrolysis gasoline stream to form a second hydrotreated pyrolysis gasoline stream and a light pyrolysis oil stream, iv) saturating the light pyrolysis oil stream and at least one additional naphtha/hydrocarbon stream to form a first naphthene stream, v) flowing the first naphthene stream to the steam cracking to form olefins.

In various embodiments, the second hydrotreated pyrolysis gasoline stream comprises $C_5$-$C_9$ compounds.

In various embodiments, the second hydrotreated pyrolysis gasoline stream comprises by weight at least 40% aromatic compounds.

In various embodiments, the light pyrolysis oil stream is not subject to transalkylating or dealkylating.

In various embodiments, the light pyrolysis oil stream comprises mainly $C_{10+}$ compounds having at least one unsaturated carbon to carbon bond and/or an aromatic ring, and the second hydrotreated pyrolysis gasoline stream comprises mainly $C_5$-$C_9$ compounds having at least one unsaturated carbon to carbon bond and/or an aromatic ring.

In various embodiments, the hydrotreating removes at least one of a nitrogen containing contaminant, a sulfur containing contaminant, or both from the raw pyrolysis gasoline stream.

In various embodiments, the at least one additional naphtha/hydrocarbon stream is a hydrotreated residue fluid catalytic cracking heavy naphtha stream comprising mainly $C_{7+}$ compounds.

In various embodiments, the hydrotreated residue fluid catalytic cracking (RFCC) heavy naphtha stream comprises 20-80% by weight of aromatic compounds.

In various embodiments, the at least one additional naphtha/hydrocarbon stream is a hydrocracked LCO naphtha comprising $C_{7+}$ compounds.

In various embodiments, the hydrocracked LCO naphtha comprises by weight at least 25% aromatic compounds.

In various embodiments, the saturating comprises hydrogenating at least a portion of the unsaturated compounds present in the light pyrolysis oil stream and the at least one additional naphtha/hydrocarbon stream in the presence of a catalyst.

In various embodiments, both the light pyrolysis oil stream and the at least one additional naphtha/hydrocarbon stream comprise aromatic compounds and the saturating converts at least 90% of the aromatic compounds to form naphthenes.

In various embodiments, prior to the saturating the light pyrolysis oil stream is processed to saturate one or more dicyclopentadiene compounds present therein.

In various embodiments, at least 40% by weight of the first naphthene stream is cracked to form olefins during the steam cracking.

According to a third aspect, the present disclosure relates to a process for producing an olefin stream from a steam-cracked hydrocarbon stream, comprising i) steam cracking a hydrocarbon stream to form a steam-cracked hydrocarbon stream and a heavy pyrolysis oil stream, wherein the steam-cracked hydrocarbon stream comprises at least one of butadiene, ethylene, propylene, and/or any combination thereof, ii) separating the steam-cracked hydrocarbon stream to form an olefin rich stream and a raw pyrolysis gasoline stream, iii) hydrotreating the raw pyrolysis gasoline stream to form a second hydrotreated pyrolysis gasoline stream and a light pyrolysis oil stream, iv) extracting a first aromatic stream and a raffinate stream from the second hydrotreated pyrolysis gasoline stream, v) flowing the raffinate stream to the steam cracking, vi) splitting the first aromatic stream to form a $C_6$ aromatics stream, a $C_7$ aromatics stream and a $C_{8+}$ aromatics stream, vii) saturating a stream comprising a second aromatic stream comprising at least a portion of the $C_6$ aromatics stream, a portion of the $C_7$ aromatics stream, a portion of the $C_{8+}$ aromatics stream, or a combination thereof, at least a portion of the light pyrolysis oil stream and at least a portion of at least one additional naphtha/hydrocarbon stream to form a first naphthene stream, viii) flowing the first naphthene stream to the steam cracking to form olefins.

In various embodiments, the hydrotreating removes at least one of a nitrogen containing contaminant, a sulfur containing contaminant, and or both from the raw pyrolysis gasoline stream.

In various embodiments, the second hydrotreated pyrolysis gasoline stream comprises mainly $C_5$-$C_9$ compounds.

In various embodiments, the second hydrotreated pyrolysis gasoline stream comprises 30-80% by weight of aromatic compounds.

In various embodiments, the light pyrolysis oil comprises mainly $C_{10+}$ compounds having at least one unsaturated carbon to carbon bond and/or an aromatic ring.

In various embodiments, the raffinate stream comprises less than 1% by weight of aromatic compounds.

In various embodiments, the first aromatic stream comprises 30-80% by weight of aromatic compounds.

In various embodiments, the splitting forms a $C_6$ aromatic stream comprising mainly $C_6$ aromatic hydrocarbons, a $C_7$ aromatic stream comprising mainly $C_7$ aromatic hydrocarbons, and a $C_{8+}$ stream comprising mainly $C_{8+}$ aromatic hydrocarbons.

In various embodiments, the at least one additional naphtha/hydrocarbon stream is a hydrotreated residue fluid catalytic cracking (RFCC) heavy naphtha stream comprising mainly $C_{7+}$ compounds.

In various embodiments, the hydrotreated residue fluid catalytic cracking (RFCC) heavy naphtha stream comprises 20-80% by weight of aromatic compounds.

In various embodiments, the at least one additional naphtha/hydrocarbon stream is a hydrocracked LCO naphtha stream comprising mainly $C_{7+}$ compounds.

In various embodiments, the hydrocracked LCO naphtha comprises by weight at least 25% aromatic compounds.

In various embodiments, the $C_{8+}$ aromatics stream comprises by weight at least 40% aromatic compounds.

In various embodiments, the second aromatic stream comprises by weight at least 50% aromatic compounds.

In various embodiments, a portion of the second aromatic stream, a portion of the light pyrolysis oil, a portion of the at least one additional naphtha/hydrocarbon stream, and/or any combination thereof, are subject to transalkylating or dealkylating prior to the saturating to form the first naphthene stream.

In various embodiments, the saturating comprises hydrogenating the unsaturated compounds present in the stream in the presence of a catalyst.

In various embodiments, the stream comprises aromatic compounds and the saturating converts at least 90% of the aromatic compounds in the stream to form naphthenes.

In various embodiments, the first naphthene stream comprises less than 20% by weight of aromatic compounds.

In various embodiments, at least 40% by weight of the first naphthene stream is cracked to form olefins during the steam cracking.

In various embodiments, prior to saturating the stream, the light pyrolysis oil, and/or any combination thereof is processed to saturate one or more dicyclopentadiene compounds present therein.

According to a fourth aspect, the present disclosure relates to a process for producing an olefin stream from a steam-cracked hydrocarbon stream, comprising i) steam cracking a hydrocarbon stream to form a steam-cracked hydrocarbon stream and a heavy pyrolysis oil stream, wherein the steam-cracked hydrocarbon stream comprises at least one of butadiene, ethylene, propylene, and/or any combination thereof, ii) separating the steam-cracked hydrocarbon stream to form an olefin rich stream and a raw pyrolysis gasoline stream, iii) hydrotreating the raw pyrolysis gasoline stream to form a second hydrotreated pyrolysis gasoline stream and a light pyrolysis oil stream, iv) extracting a first aromatic stream and a raffinate stream from the second hydrotreated pyrolysis gasoline stream, v) flowing the raffinate stream to the steam cracking, vi) splitting the first aromatic stream to form a $C_6$ stream, a $C_7$ stream, a $C_8$ xylene stream, a $C_8$ ethyl benzene rich stream, and a $C_{9+}$ aromatics stream, vii) saturating a stream comprising a second aromatic stream comprising a portion of the $C_6$ stream, a portion of the $C_7$ stream, a portion of the $C_8$ xylene stream, a portion of the $C_8$ ethyl benzene rich stream, the $C_{9+}$ aromatics stream, or a combination thereof, and at least a portion of at least one additional naphtha/hydrocarbon stream to form a first naphthene stream, viii) flowing the first naphthene stream to the steam cracking to form olefins.

In various embodiments, the hydrotreating removes at least one of a nitrogen containing contaminant, a sulfur containing contaminant, or both from the raw pyrolysis gasoline stream.

In various embodiments, the second hydrotreated pyrolysis gasoline stream comprises 30-80% by weight of aromatic compounds.

In various embodiments, the light pyrolysis oil stream comprises mainly $C_{10+}$ compounds having at least one unsaturated carbon to carbon bond and/or an aromatic ring.

In various embodiments, the raffinate stream comprises by weight less than 1% aromatic compounds.

In various embodiments, the splitting forms a $C_6$ aromatic stream comprising mainly $C_6$ aromatic hydrocarbons, a $C_7$ aromatic stream comprising mainly $C_7$ aromatic hydrocarbons, a $C_8$ xylene stream comprising mainly of xylenes, a $C_8$ ethyl benzene rich stream comprising mainly of ethyl benzene, and a $C_{9+}$ stream comprising mainly $C_{9+}$ aromatic hydrocarbons.

In various embodiments, the first aromatic stream comprises mainly aromatic compounds having at least 6 carbon atoms.

In various embodiments, the first aromatic stream comprises 30-80% by weight of aromatic compounds.

In various embodiments, the second aromatic stream comprises 30-80% by weight of aromatic compounds.

In various embodiments, the stream comprises at least 50 wt % of the second aromatic stream.

In various embodiments, the at least one additional naphtha/hydrocarbon stream is a hydrotreated residue fluid catalytic cracking (RFCC) heavy naphtha stream comprising mainly $C_{7+}$ compounds.

In various embodiments, the hydrotreated residue fluid catalytic cracking (RFCC) heavy naphtha stream comprises 20-80% by weight of aromatic compounds.

In various embodiments, the at least one additional naphtha/hydrocarbon stream is a hydrocracked LCO naphtha comprising mainly $C_{7+}$ compounds.

In various embodiments, the hydrocracked LCO naphtha comprises by weight at least 25% aromatic compounds.

In various embodiments, the $C_{9+}$ aromatics stream comprises by weight at least 40% aromatic compounds.

In various embodiments, the saturating comprises hydrogenating the unsaturated compounds present in the stream in the presence of a catalyst.

In various embodiments, the stream comprises aromatic compounds and the saturating converts at least 90% of the aromatic compounds to form naphthenes.

In various embodiments, a portion of the at least one additional naphtha/hydrocarbon stream, a portion of the second aromatic stream, and/or any combination thereof is subject to transalkylating or dealkylating prior to the saturating.

In various embodiments, the first naphthene stream comprises by weight at least 50% naphthene.

In various embodiments, at least 40% by weight of the first naphthene stream is cracked to form olefins during the steam cracking.

DETAILED DESCRIPTION OF THE EMBODIMENTS

Figure 1A:
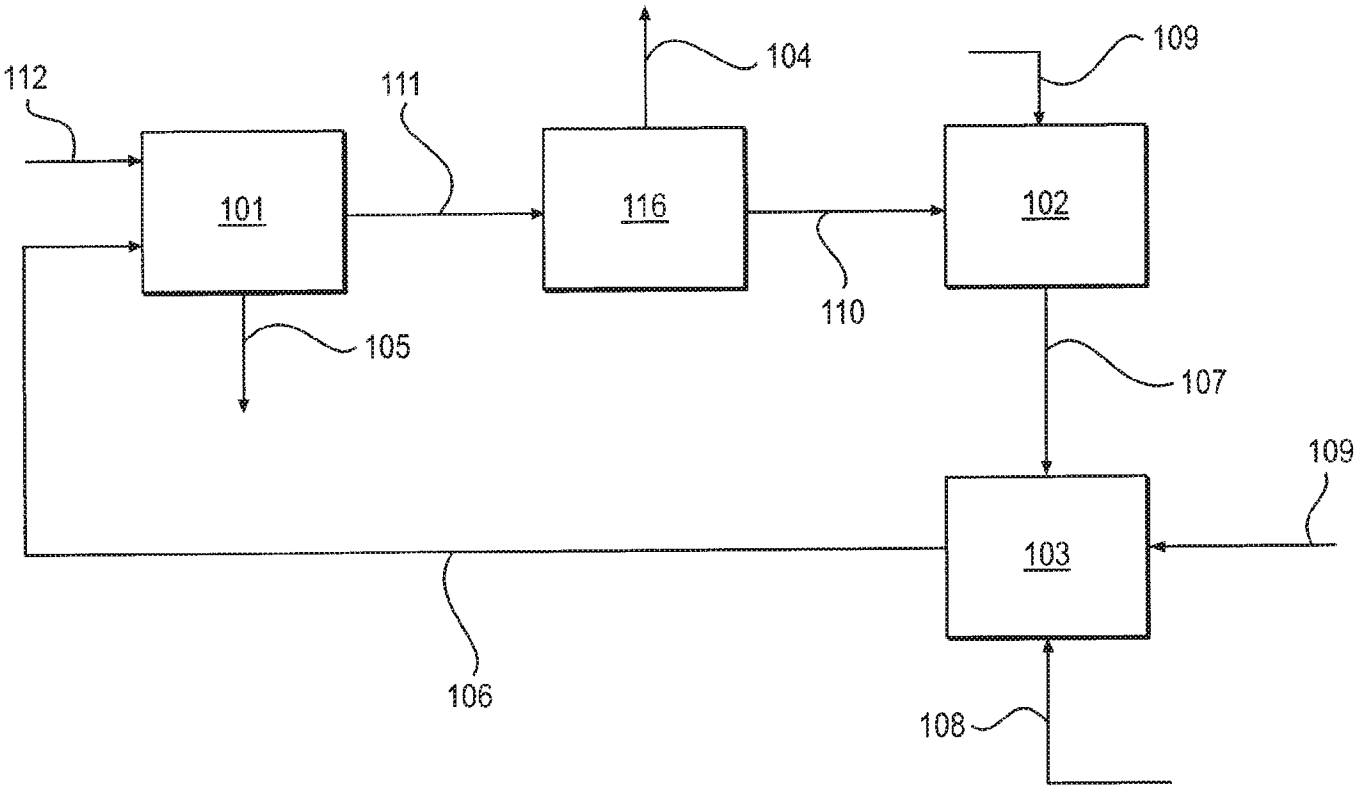
FIG. 1A is a schematic flow diagram illustrating the process steps of one aspect of the invention and products produced therefrom.

Referring now to FIG. 1A, where a process for increasing olefin production using a raw pyrolysis gasoline stream is illustrated, where a naphtha rich hydrocarbon stream is fed through a line (112) into a steam cracking unit (101) to produce a steam-cracked hydrocarbon stream (111) and a heavy pyrolysis oil stream (105). The steam-cracked hydrocarbon stream is fed to a separating unit (116) to separate the steam-cracked hydrocarbon stream (111) into an olefin rich stream (104) and a raw pyrolysis gasoline stream (110). The raw pyrolysis gasoline stream is sent to a hydrotreating unit (102) to at least partially hydrogenate aromatic and/or olefinic components with a hydrogen gas stream (109) and remove nitrogen and/or sulfur containing species from the raw pyrolysis gasoline stream (110) producing a first hydrotreated pyrolysis gasoline stream (107). The first hydrotreated pyrolysis gasoline stream (107) is directed to a saturating unit (103), mixed with at least one additional naphtha/hydrocarbon stream (108) and saturated with a hydrogen gas stream (109) to produce a first naphthene stream (106), and flowed back to the steam cracking (101) to produce olefins.

Figure 1B:
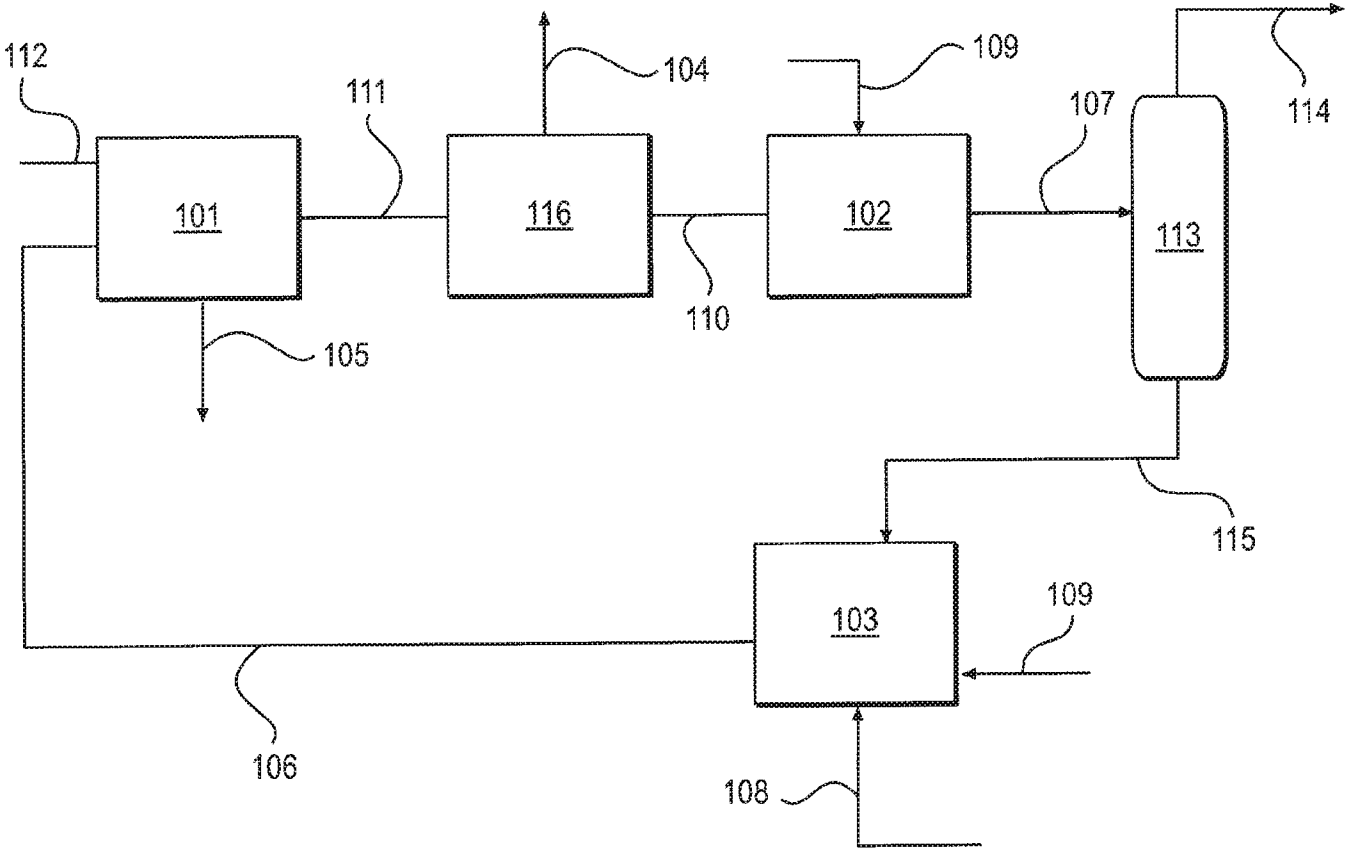
FIG. 1B is a schematic flow diagram illustrating the process steps of an alternative embodiment of the invention and products produced therefrom.

Referring now to FIG. 1B, where an alternate embodiment of the process of FIG. 1A is illustrated. A hydrocarbon stream comprising naphtha and aromatic compounds is fed through a line (112) into a steam cracking unit (101) to produce a steam-cracked hydrocarbon stream (111) and a heavy pyrolysis oil (105). The steam-cracked hydrocarbon stream is fed to a separating unit (116) where an olefin rich stream (104) and a raw pyrolysis gasoline stream (110) are produced. The raw pyrolysis gasoline stream (110) is sent to a hydrotreating unit (102) to at least partially hydrogenate olefinic and/or aromatic components with a hydrogen gas stream (109) and remove nitrogen and/or sulfur containing species producing a first hydrotreated pyrolysis gasoline stream (107). The first hydrotreated pyrolysis gasoline stream (107) is separated in a separation unit (113) to form a $C_{5-}$ stream (114) and a $C_{6+}$ stream (115). The $C_{5-}$ stream (114) is transported to the steam cracking unit (101) while the $C_{6+}$ stream (115) is directed to a saturating unit (103) mixed with at least one additional naphtha/hydrocarbon stream (108) and saturated under a hydrogen flow (109) to produce a first naphthene stream (106), and flowed back to the steam cracking (101) to produce olefins.

Figure 2:
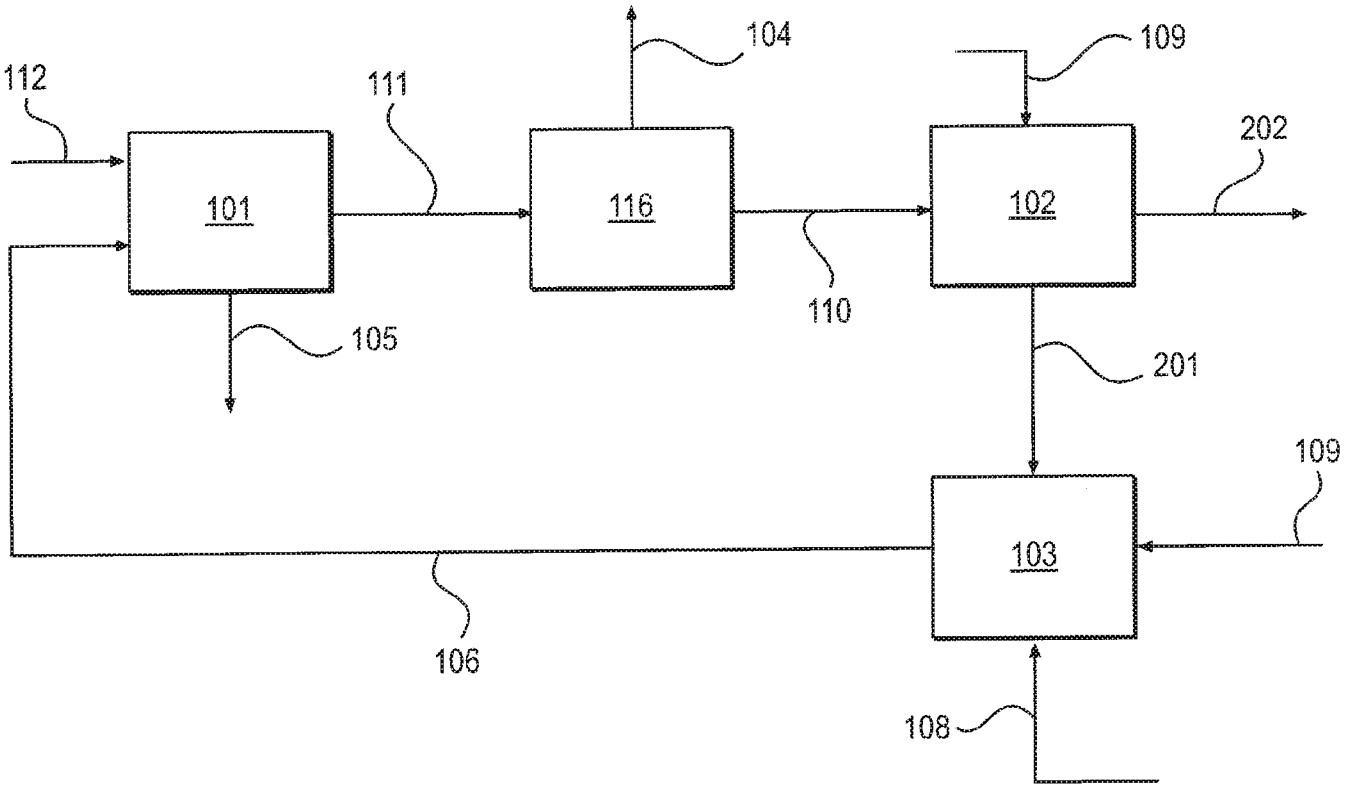
FIG. 2 is schematic flow diagram illustrating the process steps of another aspect of the invention and products produced therefrom.

Referring now to FIG. 2, where a process for increasing olefin production using light pyrolysis oil stream is illustrated. A hydrocarbon stream comprising naphtha and aromatic compounds is fed through a line (112) into a steam cracking (101) to produce a steam-cracked hydrocarbon stream (111) and a heavy pyrolysis oil (105). The steam-cracked hydrocarbon stream is fed to a separating unit (116) where an olefin rich stream (104) and a raw pyrolysis gasoline stream (110) are produced. The raw pyrolysis gasoline stream (110) is sent to a hydrotreating unit (102) to partially hydrogenate aromatic and/or olefinic components with a hydrogen gas stream (109) and remove nitrogen and/or sulfur containing species producing a second hydrotreated pyrolysis gasoline stream (202) and a light pyrolysis oil stream (201). The light pyrolysis oil stream is directed to a saturating unit (103), while the second hydrotreated pyrolysis gasoline stream (202) is transported for further processing. The light pyrolysis oil stream (201) is mixed with at least one additional naphtha/hydrocarbon stream (108) and saturated (103) under a hydrogen flow (109) to produce a first naphthene stream (106). The first naphthene stream is then flowed back to the steam cracking unit (101) to produce olefins.

Figure 3:
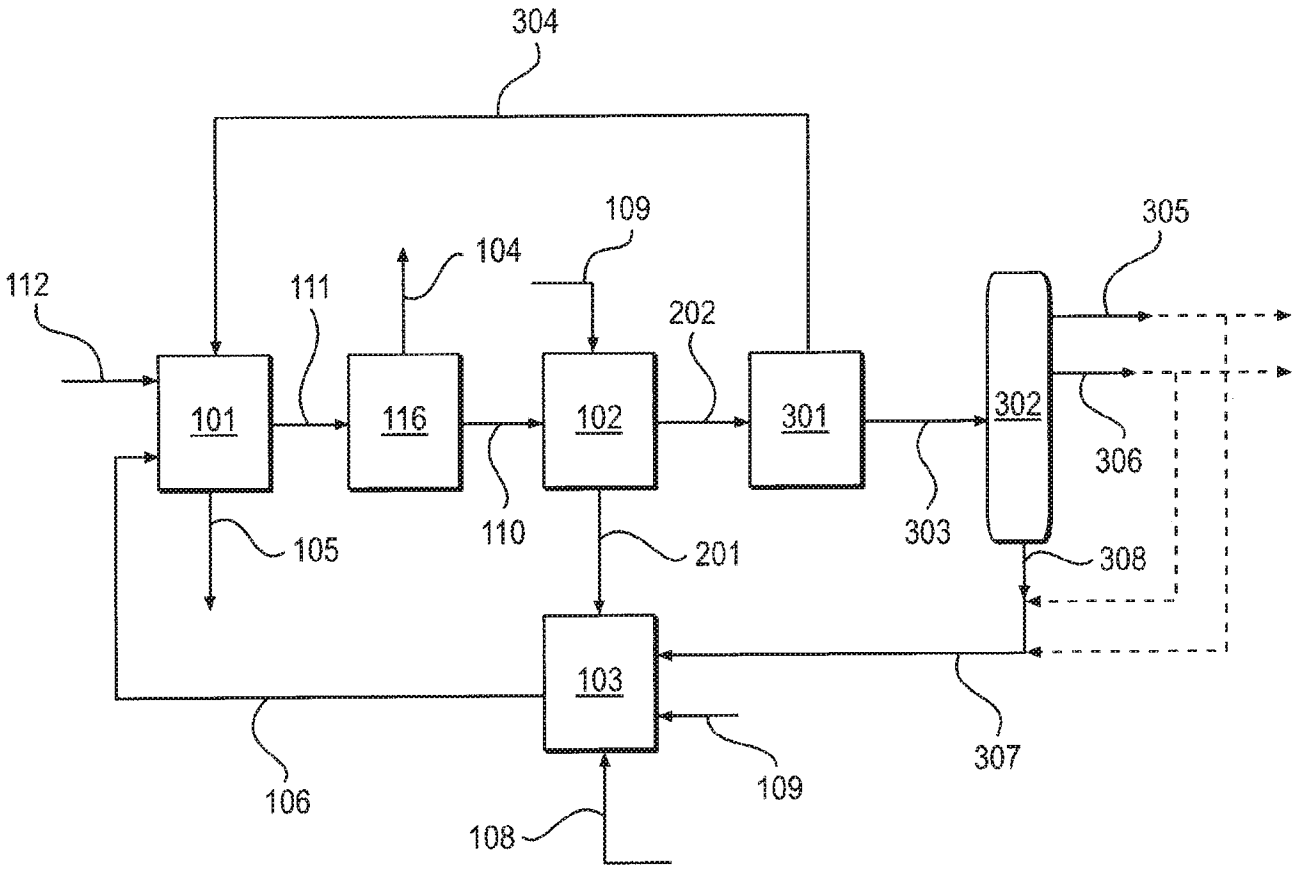
FIG. 3 is a schematic flow diagram illustrating the process steps of another aspect of the invention and products produced therefrom.

Referring now to FIG. 3, where a process for increasing olefin production within an aromatic refining process is illustrated. A hydrocarbon stream comprising naphtha and aromatic compounds is fed through a line (112) into a steam cracking unit (101) to produce a steam-cracked hydrocarbon stream (111) and a heavy pyrolysis oil (105). The steam-cracked hydrocarbon stream is fed to a separating unit (116) where an olefin rich product stream (104) and a raw pyrolysis gasoline stream (110) are produced. The raw pyrolysis gasoline stream (110) is sent to a hydrotreating unit (102) to partially hydrogenate olefinic and/or aromatic components with a hydrogen gas stream (109) and remove nitrogen and/or sulfur containing species from the raw pyrolysis gasoline stream (110) producing a second hydrotreated pyrolysis gasoline stream (202) and a light pyrolysis oil stream (201). The light pyrolysis oil stream (201) is directed to a saturating unit (103), while the second hydrotreated pyrolysis gasoline stream (202) is flowed to an extracting unit (301) to produce a first aromatic stream (303) and an aromatically deficient raffinate stream (304). The aromatically deficient raffinate stream is flowed to the steam cracking unit (101), while the first aromatic stream (303) is separated in a separating unit (302) to form a $C_6$ stream (305), a $C_7$ stream (306), and a $C_{8+}$ stream (308). A second aromatic stream (307) is formed from the $C_{8+}$ stream, and optionally at least portion of one or more of the $C_6$ stream (305) and the $C_7$ stream (306). The second aromatic stream (307), the light pyrolysis oil stream (201), and at least one additional naphtha/hydrocarbon stream (108) are mixed and saturated (103) under a hydrogen gas flow (109) to form a first naphthene stream (106). The first naphthene stream (106) is then flowed to the steam cracking unit (101) to produce olefins.

Figure 4:
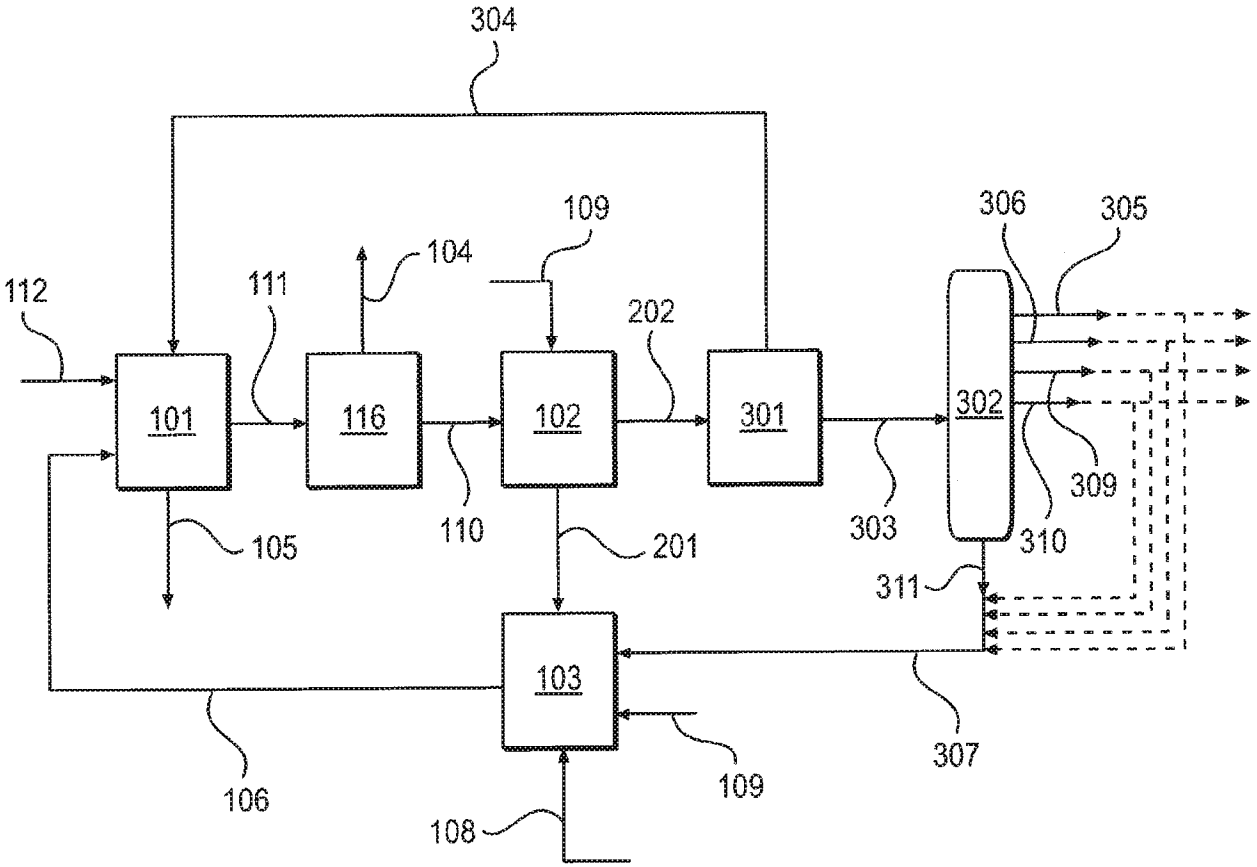
FIG. 4 is a schematic flow diagram illustrating the process steps of another aspect of the invention and products produced therefrom.

Referring now to FIG. 4 where a process for increasing olefin production within an aromatic refining process optionally without sacrificing fuel oil production is illustrated. A hydrocarbon stream comprising naphtha and aromatic compounds is fed through a line (112) into a steam cracking unit (101) to produce a steam-cracked hydrocarbon stream (111) and a heavy pyrolysis oil (105). The steam-cracked hydrocarbon stream (111) is fed to a separating unit (116) where an olefin rich product stream (104) and a raw pyrolysis gasoline stream (110) are produced. The raw pyrolysis gasoline stream (110) is sent to a hydrotreating unit (102) to partially hydrogenate olefinic and/or aromatic components with a hydrogen gas stream (109) and remove nitrogen and/or sulfur containing species producing a second hydrotreated pyrolysis gasoline stream (202) and light pyrolysis oil stream (201). The light pyrolysis oil stream (201) is directed to the saturating unit (103), while the second hydrotreated pyrolysis gasoline stream (202) is flowed to an extracting unit (301), to produce a first aromatic stream (303), and an aromatically deficient raffinate stream (304). In one embodiment, the light pyrolysis oil stream (201) is optionally directed to a fuel oil pool. The aromatically deficient raffinate stream (304) is flowed to the steam cracking unit (101), while the first aromatic stream (303) is separated in a separating unit (302) to form a $C_6$ stream (305), a $C_7$ stream (306), a $C_8$ xylene stream (309), a $C_8$ ethyl rich benzene stream (310), and a $C_{9+}$ stream (311). A second aromatic stream (307) is formed from the $C_{9+}$ stream (311), and optionally at least a portion of each of the $C_6$ stream (305), the $C_7$ stream (306), the $C_8$ xylene stream (309) and the $C_8$ ethyl benzene rich stream (310). The remaining portions of the $C_6$ stream (305), the $C_7$ stream (306), the $C_8$ xylene stream (309) and the $C_8$ ethyl benzene rich stream (310) are directed to further processing. The second aromatic stream (307) is mixed with at least one additional naphtha/hydrocarbon stream (108) and saturated (103) under a hydrogen gas flow (109) to yield the first naphthene stream (106). The first naphthene stream (106) is then flowed back to the steam cracking unit (101) to produce olefins.

According to a first aspect, the present disclosure relates to a process for producing an olefin stream, comprising steam cracking a hydrocarbon feedstock in a steam cracking unit to form a steam-cracked hydrocarbon stream (111) and a heavy pyrolysis oil (105), wherein the steam-cracked hydrocarbon stream comprises at least one of butadiene, ethylene, propylene, and/or any combination thereof.

"Steam cracking", as used herein, refers to any process that includes heating a hydrocarbon feedstock in the presence of steam to a sufficient temperature to initiate a pyrolysis reaction in order to break carbon-carbon bonds and/or carbon-hydrogen bonds, quenching the pyrolyzed hydrocarbon product to form a quenched hydrocarbon product and fractionating the quenched hydrocarbon product into a steam cracked hydrocarbon stream comprising aromatic/polyaromatics, olefins, alkanes, and/or any combination thereof and a heavy pyrolysis oil. Steam cracking processes as well as the pyrolysis reaction, temperatures, quenching, and fractioning steps are well known in the art.

The steam cracking unit (101) is operated to favor the amount of lower molecular weight olefinic components formed. The steam cracking unit forms at least two product streams: a first stream comprising relatively high volatility and low molecular weight hydrocarbon components (111), and a second stream comprising relatively high molecular weight and low volatility hydrocarbon components (105). The total output of relatively high volatility hydrocarbon components from the steam cracking unit (101) (based on the total weight of the output of the two hydrocarbon product streams (111) and (105)) is mainly a hydrocarbon stream (e.g. steam cracked hydrocarbon stream (111) made up of hydrocarbon components having a relatively lower molecular weight distribution in comparison to the molecular weight distribution of the total hydrocarbon feedstock (112) and optionally (106) added to the steam cracking unit (101) for steam cracking as well as the molecular weight distribution of the relatively lower molecular weight product of the steam cracking (e.g., the heavy pyrolysis oil (105)). In other words, the low molecular weight products formed by the steam cracking have an average volatility that is greater than the volatility of the hydrocarbon feedstock (112) and optionally (106) fed to the steam cracking unit (101) for steam cracking. In this respect, the steam cracked hydrocarbon stream (111) components have a boiling point lower than the average boiling point of the hydrocarbon feedstock added to the steam cracking unit (101).

The hydrocarbon feedstocks (112) and (106) as used herein may be selected from but is not limited to, mineral oil, crude oil, naphtha, light gasolines, gas oils, lubricating oil, fuel oil, residue and/or any combination thereof and includes an aromatic/polyaromatic hydrocarbon content by weight of at least 10%, at least 20%, at least 30%, at least 40%, at least 50%, at least 55%, at least 60%, at least 70%, at least 80%, at least 90%, or at least 95% based on the total weight of the hydrocarbon feedstock, preferably 31-49%, 33-47%, 35-45%, 37-43%, or 39-41% by weight.

In one embodiment, the hydrocarbon feedstock is naphtha from a Saudi Arabian light crude oil feedstock with aromatic/polyaromatic hydrocarbon content by weight of at least 25%, at least 20%, at least 15%, or at least 5% by weight, preferably 5-65%, 10-60%, 15-55%, 20-20%, 25-45%, 30-40% or about 45% by weight.

The hydrocarbon feedstock may be in a vapor phase, a liquid phase and/or any combination thereof.

A "sufficient temperature" as used herein refers to a hydrocarbon feedstock temperature at which the pyrolysis reaction is initiated upon the hydrocarbon feedstock. In one embodiment, the sufficient temperature may be at least 500° C., at least 600° C., at least 750° C., at least 775° C., at least 800° C., at least 825° C., at least 850° C., at least 875° C., at least 900° C., at least 925° C., at least 950° C., at least 975° C., at least 1000° C., at least 1025° C., at least 1050° C., at least 1075° C., at least 1100° C., at least 1125° C., at least 1150° C., at least 1175° C., or at least 1200° C., preferably 600-1000° C.

Aromatic/polyaromatic hydrocarbon as used herein refers to any cyclic hydrocarbons comprising at least one aromatic ring within a molecular structure. However, when used separately polyaromatic refers explicitly to cyclic hydrocarbons comprised of at least two aromatic rings while aromatic maintains the earlier definition.

Aromatically rich (aromatic-rich and/or rich in aromatics) as used herein refers to any hydrocarbon stream with an aromatic content, polyaromatic content or both by weight that is at least 10%, at least 20%, at least 30%, at least 40%, at least 50%, at least 60%, at least 70%, at least 80% or at least 90%, preferably 20%-90%, more preferably 20%-50% of the total hydrocarbon stream.

Hydrocarbon feedstocks may include a variety of chemical classes which are well known in the art. Exemplary classes include refinery gases ($C_1$-$C_4$), liquefied petroleum gas ($C_3$-$C_4$), naphtha ($C_5$-$C_{17}$), gasoline ($C_4$-$C_{12}$) kerosene/diesel fuel ($C_8$-$C_{18}$), aviation fuel ($C_8$-$C_{16}$), fuel oil ($C_{20+}$), lubricating oil ($C_{20+}$), wax ($C_{17+}$), asphalt ($C_{20+}$), coke ($C_{50+}$), and/or any combination thereof. Each respective class may be described by a boiling/volatility range.

In one embodiment, a Saudi Arabian crude oil comprises fractions with a boiling range under 1 atmosphere of pressure of less than 0° C. refinery gases (dry/wet), 32° C.-182° C. naphtha, 193° C.-271° C. kerosene, 271° C.-321° C. light gas oil, 321° C.-427° C. heavy gas oil, 371-566° C. vacuum gas oil, and more than 566° C. residue.

Each feedstock class possesses a boiling point range and a carbon atom distribution that may vary between feedstocks largely due to regionally defined differences in composition and extraction methods, and as a result may produce different petrochemical products when undergoing refining processes.

In one embodiment, a Saudi Arabian light crude oil comprises about 2% refinery gases ($C_1$-$C_2$), 20%-26% naphtha ($C_{20}$-$C_{26}$), 7%-12% kerosene ($C_7$-$C_{12}$), 10%-14% wax ($C_{17}$-$C_{22}$), and 35%-40% residue ($C_{20}$-$C_{90}$).

Chemical components including but not limited to aromatic/polyaromatic compounds, olefins, polyolefins, arenes, paraffins, alkanes, cyclic compounds, polycyclic compounds, heterocyclic compounds, inert gases, organic sulfur and/or nitrogen compounds, and/or any combination thereof may be present in the described feedstock classes.

A steam cracked hydrocarbon stream as used herein refers to a light end hydrocarbon fraction formed by steam cracking the hydrocarbon feedstock and includes a hydrocarbon component with a boiling point less than 216° C., and less than or equal to 12 carbon atoms within the molecular structures of the hydrocarbon components present in the light end hydrocarbon fraction.

A heavy pyrolysis oil (or pyrolysis oil) stream (105) as used herein refers to a hydrocarbon oil fraction produced during the steam cracking optionally a separation column bottom or raffinate, which may include hydrocarbons having at least 12 carbon atoms, and/or at least one polyaromatic compound, and a boiling point of at least 216° C. In one embodiment, heavy pyrolysis oil (105) is a fuel oil component.

In one embodiment, the heavy pyrolysis oil (105) includes a polyaromatic hydrocarbon content by weight of at least 10%, at least 15%, at least 20%, at least 25%, at least 30%%, at least 35%, at least 40%, at least 45%, at least 50%, at least 55%, at least 60%, at least 65%, at least 70%, at least 75%, at least 80%, at least 85%, or at least 90% by weight based on the total weight of the heavy pyrolysis oil, preferably 10-90%, 20-80%, 30-70%, 40-60% or about 50% by weight.

In one embodiment, the polyaromatic hydrocarbons are selected from but not limited to naphthalene, phenanthrene, anthracene, biphenyl or any combination thereof and may be isolated or combined for use in fuel oil.

The heavy pyrolysis oil (105) is an example of a second product stream with a relatively higher molecular weight than the average molecular weight of the hydrocarbon feedstock (112) and (106) added to the steam cracking unit (101) for steam cracking. The heavy pyrolysis oil (105) or bottoms product formed by the steam cracking have a lower volatility than the average volatility of any stream and/or the total hydrocarbon feedstock materials added to the steam cracking unit (101).

The total amount of lower molecular weight components formed by the steam cracking is preferably greater than the total amount of the heavy pyrolysis oil (101) and/or the heavy molecular weight materials formed by the steam cracking. Preferably the lower molecular weight hydrocarbon stream formed by the steam cracking contains 30-99% by weight, preferably at least 50%, at least 70%, at least 80%, at least 90% and most preferably at least 95% by weight of lower molecular weight materials in comparison to the average molecular weight of the feedstock materials that are added to the steam cracking unit (101).

The steam cracking unit (101) itself may include at least one pyrolysis furnace optionally fluidly connected to at least one heat exchanger which is optionally fluidly connected to at least one adjacent primary fractionating column. The at least one pyrolysis furnace may comprise one or more of a convection stage, a radiation stage optionally traversed by a plurality of fluidly connected tubes for carrying the hydrocarbon feedstock from a convection stage inlet through a convection stage interior to a radiation stage interior and terminating at a radiation stage outlet. The pyrolysis furnace may be operated at low pressure range of 100-300 kPa, preferably 120-280 kPa, more preferably 160-240 kPa, to account for a higher molar output of pyrolyzed hydrocarbon product compared to a molar input of the hydrocarbon feedstock.

An exemplary steam cracking process within a steam cracking unit may include, a hydrocarbon feedstock passing through the plurality of fluidly connected tubes is preheated and mixed with steam in the convection stage interior to a temperature of at least 400° C., at least 425° C., at least 450° C., at least 475° C., at least 500° C., at least 525° C., at least 550° C., at least 575° C., or at least 600° C., preferably 400-600° C. or about 500° C., before being passed to the radiation stage. Within the radiation stage at least one array of burners rapidly heats at least a portion of the hydrocarbon feedstock to the sufficient temperature to form the pyrolyzed hydrocarbon product.

As a note, residence time as used herein refers to the time period required to convert a hydrocarbon feedstock to a pyrolyzed hydrocarbon feedstock in a radiant stage. The residence time may vary depending upon the chemical components of the hydrocarbon feedstock as well and may determine the amount of low molecular weight, high volatility hydrocarbon components produced from a hydrocarbon feedstock. An exemplary residence time range may be about 0.02-1.0 seconds, preferably about 0.05-0.5 s.

The steam cracking continues with the pyrolyzed hydrocarbon product being passed through the radiation stage outlet to a fluidly connected heat exchanger where rapid quenching lowers the pyrolyzed hydrocarbon feedstock temperature to stabilize the pyrolyzed hydrocarbon product composition and terminate the pyrolysis reaction. An exemplary quenching occurs within less than 0.01 s, 0.02 s, 0.03 s, 0.04 s, or 0.05 s of the pyrolyzed hydrocarbon feedstock exiting the radiant stage. Heat exchangers are well known to those skilled in the art with an exemplary heat exchanger being a quenching boiler.

Finally, at least one adjacent fractionating column which are well known by those skilled in the art, may then divide the quenched hydrocarbon feedstock to form the steam cracked hydrocarbon stream (111) into one or more light end fractions and a heavy pyrolysis oil (105) as a column bottom fraction.

As a note, the mass ratio of steam to hydrocarbon feedstock in the convection stage mixing may be used to increase the output of olefins depending upon the hydrocarbon feedstock used. The mass ratio of steam to hydrocarbon by weight for a hydrocarbon feedstock may be at least 20%, at least 25%, at least 30%, at least 35%, at least 40%, at least 45%, at least 50%, at least 55%, at least 60%, at least 65%, at least 70%, at least 75%, or at least 80%, preferably 30-80%, 40-70% or 50-60% by weight.

The present disclosure also relates to a process that includes separating (116) the steam-cracked hydrocarbon stream (111) to form an olefin rich stream (104) and a raw pyrolysis gasoline stream (110). Separating processes are well known by those skilled in the art.

The olefin rich stream (104) may comprise at least one olefin selected from but not limited to ethylene, butadiene, propylene or any combination thereof.

A raw pyrolysis gasoline stream (110) as used herein refers to a steam-cracked hydrocarbon stream comprising a $C_5$-$C_{12+}$ component, an aromatic/polyaromatic hydrocarbon component and having an aromatic/polyaromatic hydrocarbon content by weight of 1%-95%, preferably at least 1%, at least 10%, at least 20%, at least 30%, at least 40%, at least 60%, at least 70%, at least 80%, at least 90%, or at most 95%.

The olefin-rich components (104) separated from the low molecular weight steam cracking output (e.g., the steam cracked hydrocarbon stream (111)) preferably represents 50-99% by weight, preferably at least 50% by weight of the low molecular weight output, or preferably, 60-95%, 70-85%, or about 80% by weight based on the total weight of the low molecular weight steam cracking output (111). Of the total amount of olefin components within the olefin rich stream (104), lower molecular weight olefin components such as butadiene, ethylene, propylene and butene are preferred. It is preferred that these lower molecular weight components represent at least 50% by weight of the total amount of olefin components that are separated in the separating step (116) in which the olefin components are separated from the raw pyrolysis gasoline (110).

The olefin-rich stream (104) has a relatively lower molecular weight and higher volatility than the raw pyrolysis gasoline (110) and is typically separated from the raw pyrolysis gasoline (110) by distillation through one or more distillation columns. The olefin-rich stream (104) may be obtained as the lights and/or overhead from the distillation. Likewise, the raw pyrolysis gasoline (110) may represent a bottoms product and/or an intermediate product having a volatility less than the volatility of the average volatility of the olefin-rich stream (104) but higher than the average volatility of a bottoms product that remains after the olefin-rich steam and the raw pyrolysis gasoline are separated from a typical steam cracking unit's output (111).

Preferably the entire raw pyrolysis gasoline stream (110) is directed into the hydrotreating unit (102) where the hydrotreating may result in the formation of separate output hydrocarbon streams including a first hydrotreated pyrolysis gasoline (107) and a light pyrolysis oil stream (201). Preferably both the hydrotreated pyrolysis gasoline (107) and the light pyrolysis oil stream (201) have a relatively lower amount of nitrogen, sulfur and metal containing components in comparison to the concentration of such components that enter the hydrotreating unit (102) from the raw pyrolysis gasoline (110). The hydrotreated pyrolysis gasoline (107) preferably represents a major amount of the hydrocarbon stream formed by the hydrotreating step. The amount of the first hydrotreated pyrolysis gasoline (107) formed in comparison to the amount of the light pyrolysis oil stream (201) is preferably 60-90% by weight based on the total weight of raw pyrolysis gasoline (110). In embodiments of the invention in which the output of the hydrotreating unit (102) does not form separate streams of a hydrotreated pyrolysis gasoline (107) and a light pyrolysis oil stream (201), the entire output (107) may be directly to one or more further downstream operations such as aromatic saturation, separation to form streams of higher and lower volatility, extraction to form streams of relatively higher and lower solubility, and the like. As a note, the second hydrotreated pyrolysis gasoline stream (202) preferably has a higher volatility and lower molecular weight component content when compared to the steam cracked hydrocarbon stream (111).

The present disclosure also relates to hydrotreating a raw pyrolysis gasoline stream (110) in a hydrotreating unit (102) to form a first hydrotreated pyrolysis gasoline stream (107).

Hydrotreating as used herein may refer to any process where an hydrocarbon stream is reacted in a hydrotreating unit (102) with hydrogen gas (109) and in the presence of at least one hydrotreating catalyst to at least partially hydrogenate olefins and/or aromatics/polyaromatic components, and remove components containing sulfur, nitrogen, oxygen, metals (e.g. arsenic, lead, etc.), or any combination thereof. Exemplary nitrogen and sulfur containing components include pyridine, pyrrole, porphyrins, hydrogen sulfide, methyl mercaptan, phenyl mercaptan, cyclohexythiol, dimethyl sulfide, hydrogen sulfide, and thiocyclohexane.

A hydrotreating unit (102) comprises a preheating zone, optionally fluidly connected to at least one hydrotreatment reactor, optionally fluidly connected to a separating zone optionally connected to a fractionation zone. The at least one hydrotreatment reactor may include at least two stages composing at least one layer/bed of a hydrotreating catalyst, with at least one quenching zone optionally separating the stages.

An exemplary hydrotreating unit (102) operation may include preheating the raw pyrolysis gasoline stream (110) in a preheating zone to a temperature of at least 50° C., and mixing the preheated raw pyrolysis gasoline with a preheated hydrogen gas flow (109) to form a hydrogen/raw pyrolysis gasoline stream within a pressure range of for example 490 psig-1600 psig, contacting the hydrogen/raw pyrolysis gasoline stream with a first hydrotreatment catalyst in a hydrotreatment reactor's first stage to at least partially hydrogenate diolefins, olefins, and/or aromatics/polyaromatic components, at a temperature range of 50° C.-450° C., preferably 275° C.-450° C., and a reaction pressure range of for example 490 psig-1600 psig, contacting the hydrogen/raw pyrolysis gasoline with a cold hydrogen gas stream in the quenching zone to lower the hydrogen/raw pyrolysis gasoline temperature, reacting the hydrogen/raw pyrolysis gasoline with a second hydrotreatment catalyst in a second stage to convert components containing sulfur, nitrogen, metals (e.g. arsenic, lead, etc.), and/or any combination thereof into sulfides, ammonia, and metal sulfides respectively at a temperature range of 170° C.-450° C., preferably 275° C.-450° C., and a reaction pressure range of 490 psig-1600 psig, removing the sulfides, ammonia, metal sulfides, excess hydrogen, and/or any combination thereof in the separating zone to produce a hydrotreated pyrolysis gasoline stream at a temperature range of 60° C.-400° C. and a reaction pressure range of 450 psig-1550 psig, and dividing the hydrotreated pyrolysis gasoline stream in the fractionating zone to produce a first hydrotreated pyrolysis gasoline stream containing a light pyrolysis oil stream (201) wherein the operating conditions of the fractionating zone include a temperature range from 40° C.-450° C. and a pressure range of about 0.7 psig-290 psig.

Hydrotreating catalysts are well known by those skilled in the art and typically include at least one metal attached to a support material. Exemplary metals may include group 6, 8, 9, 10, 11 metals, preferably one or more of molybdenum, cobalt, nickel, tungsten, gold, platinum, iridium, palladium, osmium, silver, rhodium, and ruthenium. The support material may be selected from materials such as a molecular sieves, alumina, and/or silica-alumina, zeolites and combinations thereof.

In cases where the raw pyrolysis gasoline (110) contains a large aromatic content, a high sulfur content, or both, heat production during the partial hydrogenation, the converting of sulfur containing components and/or both may cause runaway reaction and lead to catastrophic unit failure. A hydrotreating unit (102) incorporating multiple fluidly connected hydrotreatment reactors with multiple catalyst layers/beds to account for the temperature increase may be utilized. In one embodiment the hydrotreating unit (102) comprises at least two hydrotreating reactors with 4-30 hydrotreating catalyst beds each separated by a quenching zone.

The first hydrotreated pyrolysis gasoline stream (107) may include at least $C_5$-$C_{10+}$ hydrocarbons. The first hydrotreated pyrolysis gasoline stream (107) may comprise 10-30% by weight, preferably at least 15%, preferably at least 20% of $C_6$ compounds; 5-25% by weight, preferably at least 10%, preferably at least 15% of $C_7$ compounds; 5-20% by weight, preferably at least 8%, preferably at least 10%, more preferably at least 12% of $C_{8+}$ compounds. In one embodiment, the first hydrotreated pyrolysis gasoline stream (107) comprises 40-99%, 50-85%, 60-80%, preferably at least 95% of $C_{5+}$ compounds.

At least one hydrocarbon component of the first hydrotreated pyrolysis gasoline stream (107) may be selected from the group consisting of but not limited to benzene ($C_6$), toluene ($C_7$), xylenes ($C_8$), ethylbenzene ($C_8$), other alkylated aromatic compounds and/or any combination thereof.

Due to a rich aromatic content, the first hydrotreated pyrolysis gasoline stream (107) may serve as feed for the production of aromatic products, olefin products or both. The aromatic content of the hydrotreated pyrolysis gasoline stream (107) may be 40-90%, 50-80%, 60-70% by weight, preferably be at least 40%, at least 41%, at least 42%, at least 43%, at least 44%, at least 45%, at least 46%, at least 47%, at least 48%, at least 49%, at least 50%, at least 51%, at least 52%, at least 53%, at least 54%, at least 55%, at least 56%, at least 57%, at least 58%, at least 59%, at least 60%, at least 65%, at least 70%, at least 80%, at least 85%, or at most 90% by weight, relative to the first hydrotreated pyrolysis gasoline stream (107). In one embodiment, the first hydrotreated pyrolysis gasoline stream (107) comprises 40-80%, 50-70% or about 70% by weight, preferably at least 40% by weight of aromatic compounds.

In one embodiment, a portion of the first hydrotreated pyrolysis gasoline stream (107) is subject to transalkylating and/or dealkylating. In this regard the portion of the first hydrotreated pyrolysis gasoline stream is treated with a catalyst that is different from the catalyst used in the hydrotreating or the saturating, and/or the hydrotreated pyrolysis gasoline stream is subject to processing conditions that result in transalkylating/dealkylating in no more than 5% by weight of the aromatic compounds, preferably no more than 1.0%, 0.5% or 0.1% by weight.

Typically, transalkylating/dealkylating steps are used to increase the production of valuable aromatics such as benzene and xylenes by adding or removing alkyl groups from heavy aromatic components such as $C_{7+}$ components in hydrocarbon streams. Eliminating transalkylating/dealkylating steps may provide an eventual increase in olefin production by increasing the $C_{7+}$ aromatic content of the hydrocarbon stream entering a saturating unit (103). This represents a distinct and critical departure from existing refining techniques by emphasizing olefin production over aromatics. In one embodiment the $C_{7+}$ aromatic content of the first hydrotreated pyrolysis gasoline stream (107) that is sent to the saturating unit (103) comprises 5-80% by weight, preferably more than 5%, more than 10%, more than 15%, more than 20%, more than 25%, more than 30%, more than 30%, or more than 40% of $C_{7+}$ aromatic content by weight.

"Light pyrolysis oil stream", as used herein, refers to an oil fraction within the first hydrotreated pyrolysis gasoline stream (107) that may include compounds with at least 8, at least 9, at least 10 carbon atoms, optionally with at least one unsaturated carbon to carbon bond, at least one aromatic ring and/or any combination thereof. In one embodiment the light pyrolysis oil stream (201) comprises $C_{10+}$ compounds with at least one unsaturated carbon to carbon bond and/or an aromatic ring.

The light pyrolysis oil stream (201) may include an aromatic and/or polyaromatic hydrocarbon content of 1-90% by weight, preferably at least 1%, at least 5%, at least 6%, at least 7%, at least 8%, at least 9%, at least 10%, at least 11%, at least 12%, at least 13%, at least 14%, at least 15%, at least 20%, at least 21%, at least 22%, at least 23%, at least 24%, at least 25 at least 30%, at least 35%, at least 40%, at least 41%, at least 42%, at least 43%, at least 44%, at least 45%, at least 46%, at least 47%, at least 48%, at least 49%, at least 50%, at least 60%, at least 70%, at least 80%, or at most 90% by weight. In one embodiment, the light pyrolysis oil stream (201) comprises by weight at least 40% aromatic compounds, polyaromatic compounds and/or any combination thereof.

Polyaromatic hydrocarbons within the light pyrolysis oil stream (201) may be selected from but not limited to naphthalene, phenanthrene, anthracene, biphenyl or any combination thereof. In one embodiment, the light pyrolysis oil stream (201) comprises 10%-40% naphthalene, 1%-10% dimethyl benzene, 1%-10% biphenyl, and 1%-10% ethyl benzene by weight.

The present disclosure also relates to saturating the first hydrotreated pyrolysis gasoline stream (107) and, at least one additional naphtha/hydrocarbon stream (108) in a saturating unit (103) to form a first naphthene stream (106).

"Saturating", as used herein, refers to any process where an aromatic- and/or polyaromatic-rich hydrocarbon stream is reacted in the presence of hydrogen gas and a saturating catalyst to reduce (hydrogenate) carbon-carbon double bonds resulting in the conversion of aromatic components, polyaromatic components and/or any combination thereof present in a hydrotreated, aromatically rich hydrocarbon stream and/or stream, into one or more naphthenes.

Of particular interest is the inclusion of a saturation unit (103) for a refinery process. Conventionally, aromatic saturation is not utilized to a significant degree when refining hydrocarbon products derived from mineral oil. However, in embodiments of the invention aromatic saturation is used as a technique for increasing olefin formation. In this regard, the total amount of aromatic components that is separated or isolated from the feed streams treated in this embodiment of the invention are substantially lower than the amount of aromatic components that are input into the process. For example, based on the total weight of aromatic components that are used as feed stream to either the steam cracking (101) (optionally separate from any recycle streams), or input through other streams such as an additional hydrocarbon/naphtha stream (108), the aromatic components are reduced by an amount of 50-99.5%, preferably 60-99.5%, 70-99.5%, 80-99%, 85-95% or about 90% by weight in comparison to the total amount of aromatic components that are added to the process as new hydrocarbon feedstock.

A saturating unit (103) may include at least one saturating reactor including a mixing zone and a reaction zone, wherein the reaction zone comprises single and/or multiple layers/beds of a saturating catalyst, with at least one quenching zone separating multiple layers/beds in the reaction zone, and at least one hydrogen gas inlet along with at least two saturation unit stream inlets.

An exemplary saturating operation may include combining at least one aromatic- and/or polyaromatic-rich hydrocarbon stream with a hydrogen gas flow and optionally an additional naphtha/hydrocarbon stream in the mixing zone to form a saturating stream, contacting the saturating stream with at least one layer/bed of a saturating catalyst at a saturating temperature in the range of 200° C.-400° C. and a saturating pressure range of 400 psig-1500 psig, and quenching the saturating stream to form the first naphthene stream.

The saturating catalyst may comprise at least one metal attached to a support material. Exemplary metals may include group 6, 8, 9, 10, 11 metals, preferably molybdenum, cobalt, nickel, tungsten, gold, platinum, iridium, palladium, osmium, silver, rhodium, and ruthenium. The support material may be selected from materials such as a molecular sieves, alumina, and silica-alumina. In one embodiment the saturating comprises reacting the first hydrotreated pyrolysis gasoline (107), at least one additional naphtha/hydrocarbon stream (108), or both with hydrogen in the presence of a catalyst.

The saturating (103) may not be limited to a single aromatic- and/or polyaromatic-rich feedstock. One or more additional naphtha/hydrocarbon streams (108) may also be saturated together with and/or as a stream with the first hydrotreated pyrolysis gasoline (107) to produce the first naphthene stream (106). As a result, in one embodiment, the present disclosure may be used to provide increased olefin production relative to the use of only the first hydrotreated pyrolysis gasoline stream (107). In this embodiment additional naphtha/hydrocarbon streams (108) with varied aromatic/polyaromatic contents are introduced into the saturating and/or steam cracking. In one embodiment, a first hydrotreated pyrolysis gasoline stream (107) and at least two, at least three, or at least four additional naphtha/hydrocarbon streams (108) are saturated. The first hydrotreated pyrolysis gasoline (107) may comprise by weight 5-80% by weight, preferably at least 5%, at least 10%, at least 15%, at least 20%, at least 25%, at least 30%, at least 35%, at least 40%, at least 45%, or at least 50% by weight of a stream of the first hydrotreated pyrolysis gasoline/additional naphtha/hydrocarbon stream used to produce the first naphthene stream (106).

Additional naphtha/hydrocarbon streams (108) may be selected from any hydrocarbon stream containing at least one aromatic component, at least one polyaromatic component and/or any combination thereof. Examples of additional naphtha/hydrocarbon streams (108) including but not limited to raw pyrolysis gasoline (RPG), hydrotreated pyrolysis gasoline, reformate, heavy aromatics, kerosene, jet oil, atmospheric gas oil, residue fluid catalytic cracking (RFCC) gasoline, fluid catalytic cracking (FCC) gasoline, light cracked naphtha, RFCC heavy naphtha, coker naphtha, shale oil, naphtha from coal liquefaction, hydrocracked LCO naphtha and any combinations thereof. In one embodiment, the additional naphtha/hydrocarbon stream (108) is an RFCC heavy naphtha stream. In one embodiment, the additional naphtha/hydrocarbon stream (108) is hydrocracked LCO naphtha.

The additional naphtha/hydrocarbon stream (108) may have a range of aromatic/polyaromatic content and components having a range of carbon number and carbon chain length. In one embodiment the at least one additional naphtha/hydrocarbon stream (108) is a hydrotreated RFCC heavy naphtha stream comprising $C_{7+}$ compounds. In one embodiment, the at least one additional naphtha/hydrocarbon stream (108) is hydrocracked LCO naphtha comprising $C_7$-$C_{12+}$ compounds.

Aromatic/polyaromatic content within the additional naphtha/hydrocarbon stream (108) may be 10-90% by weight, preferably at least 15%, at least 20%, at least 25%, at least 30%, at least 35%, at least 40%, at least 41%, at least 42%, at least 43%, at least 44%, at least 45%, at least 46%, at least 47%, at least 48%, at least 49%, at least 50%, at least 55, or at least 60% by weight of the total additional naphtha/hydrocarbon stream (108). In one embodiment, the hydrotreated RFCC heavy naphtha stream comprises by weight at least 20% aromatic compounds, polyaromatic compounds, and/or any combination thereof. In one embodiment, the hydrocracked LCO naphtha comprises at least 25% aromatic compounds, polyaromatic compounds and/or any combination thereof.

In embodiments of the invention, any of a light pyrolysis oil stream (201), an aromatically-rich fraction, a first hydrotreated pyrolysis gasoline (107) and/or an additional naphtha/hydrocarbon stream (108) are subject to the saturating in the saturating unit (103), the major portion of aromatic and, optionally olefinic, components are saturated to form saturated products (see FIG. 2 and further herein). Preferably 50-99.5% by weight of the total amount of aromatic and, optionally olefin, components that are subject to the saturating are fully or partially saturated such that all carbon-carbon double bonds are reduced, more preferably, 60-99 mol %, 70-98 mol %, 80-95 mol %, or about 90 mol % of the carbon-carbon double bonds are reduced.

Other embodiments of the present disclosure may be distinguished from conventional refinery processes according to the volatility, molecular weight distribution characteristics and compositional characteristics of the feedstocks (aromatic components) which are subject to saturating in the saturation unit. In conventional saturating processes it is desirable to limit the volatility and/or molecular weight and/or compositional characteristics of the feedstock which is subject to the saturating. However, in embodiments of the invention the aromatic components may be of wide range in composition, volatility and/or molecular weight. The feedstocks for the saturating may include both organic compounds having a single aromatic ring and polyaromatic compounds and optionally one or more other non-aromatic unsaturated compounds. In this respect such feedstocks for saturating may include hydrocarbon components such as benzene which are of relatively low molecular weight in comparison to higher molecular weight and lower volatility materials such as derivatives of benzene, polyaromatic components such as naphthalene, biphenyl and others. The boiling point range of materials that are added to the saturating may differ between high boiling and low boiling by 10-250° C., 20-240° C., 30-230° C., 40-220° C., 50-200° C., or about 175° C. These differences in volatility may represent differences between aromatic components which are present in substantial amounts in the hydrocarbon feed streams that are subject to aromatic saturating. For example, the aromatic components having a relatively lower boiling point (higher volatility) may represent 10-40% by weight of the total feed into the saturating unit (103) whereas the aromatic components having a relatively higher boiling point and lower volatility may likewise represent 10-40% by weight of the aromatic components which are fed to the saturating unit (103). In this way the aromatic component-containing feedstock that is subject to the saturating has a very broad range of volatility, molecular weight and/or boiling point.

Dicyclopentadiene (DCP), a hydrocarbon with a low boiling point (170° C.) relative to the average boiling point of the light pyrolysis oil stream, may be present in the light pyrolysis oil stream (201), the hydrotreated gasoline stream (107), the additional naphtha/hydrocarbon stream (108), and/or any combination thereof. DCP may unfavorably deactivate the saturating catalyst by polymerizing during the saturating. To reduce the likelihood of DCP polymerizing, processing the light pyrolysis oil stream (201), the hydrotreated gasoline stream (107), the additional naphtha/hydrocarbon stream (108), and/or any combination thereof to remove DCP prior to the saturating may be advantageous. Exemplary processing procedures may include fractional crystallization, hydrogenation (i.e. saturation), and distillation. In one embodiment, prior to the saturating the first hydrotreated pyrolysis gasoline stream (107) is processed to saturate one or more dicyclopentadiene compounds present therein producing a DCP deficient hydrotreated gasoline stream, the additional naphtha/hydrocarbon stream (108) or any combination thereof, wherein in the DCP is present in an amount of less than 1.0%, preferably less than 0.5%, more preferably less than 0.1% by weight relative to the stream which contains the DCP.

The saturating may convert 10-99% by weight, preferably at least 10%, at least 15%, at least 20%, at least 25%, at least 30%, at least 40%, at least 50%, at least 60%, at least 70%, at least 75%, at least 80%, at least 81%, at least 82%, at least 83%, at least 84%, at least 85%, at least 86%, at least 87%, at least 88%, at least 89%, at least 90%, at least 91%, at least 92%, at least 93%, at least 94%, at least 95%, at least 96%, at least 97%, at least 98%, or at most 99% of the aromatic components, the polyaromatic components or any combination thereof into naphthenes. In one embodiment, the saturating converts at least 90% of the aromatic rings in the first hydrotreated pyrolysis gasoline (107), the additional naphtha/hydrocarbon stream (108) and/or both into naphthenes.

The first naphthene stream (106) as used herein refers to an output hydrocarbon stream from the saturating wherein the output hydrocarbon stream's naphthene content is higher than the first hydrotreated gasoline stream (107), the at least one additional naphtha/hydrocarbon stream (108), and/or any combination thereof. In one embodiment the first naphthene stream (106) comprises a naphthene content of 60-99% by weight, preferably at least 60%, at least 61%, at least 62%, at least 63%, at least 64%, at least 65%, at least 66%, at least 67%, at least 68%, at least 69%, at least 70%, at least 71%, at least 72%, at least 73%, at least 74%, at least 75%, at least 76%, at least 77%, at least 78%, at least 79%, at least 80%, at least 81%, at least 82%, at least 83%, at least 84%, at least 85%, at least 86%, at least 87%, at least 88%, at least 89%, at least 90%, at least 91%, at least 92%, at least 93%, at least 94%, at least 95%, at least 96%, at least 97%, at least 98%, or at most 99% by weight.

Flowing the first naphthene stream (106) to the steam cracking unit (101), as it relates to the present disclosure refers to any process where a naphthene-rich hydrocarbon stream is transported to undergo a pyrolysis reaction to specifically produce an olefin stream, 35%-99% by weight, preferably at least 35%, at least 36%, at least 37%, at least 38%, at least 39%, at least 40%, at least 41%, at least 42%, at least 43%, at least 44%, at least 45%, at least 46%, at least 47%, at least 48%, at least 49%, at least 50%, at least 60%, at least 70%, at least 80%, at least 90%, at least 95%, or at most 99% of a first naphthene stream's (106) naphthene content may be steam-cracked to form an olefin stream. In one embodiment, at least 40-45%, by weight of the first naphthene stream (106) is steam-cracked (101) to form an olefin stream.

In an alternative embodiment (e.g., FIG. 1B), the process further involves splitting (113) the first hydrotreated pyrolysis gasoline stream (107) to form a $C_{5-}$ stream (114) and a $C_{6+}$ stream (115), saturating the $C_{6+}$ stream (115), the additional naphtha/hydrocarbon stream (108), or both in the saturating unit (103) to form a second naphthene stream (106), flowing the second naphthene stream (106) to form an olefin stream, and recycling the $C_{5-}$ stream (114) to the steam cracking unit (101).

Splitting (113) may include any process wherein a hydrotreated hydrocarbon stream is separated into at least two streams composed of a range of hydrocarbons components separated by volatility. An exemplary splitting process is a distillation comprising at least one or more distillation columns and is well known by those skilled in the art.

$C_{5-}$ as used herein refers to a hydrocarbon stream wherein the hydrocarbon components include 5 or less carbon atoms, preferably 4 or less carbon atoms, more preferably 3 or less carbon atoms in a hydrocarbon chain and constitute at least 70% by weight, preferably at least 85% by weight, more preferably at least 90% by weight of the total weight of the $C_{5-}$ stream.

$C_{6+}$ as used herein refers to an hydrocarbon stream wherein the hydrocarbon components include 6 or more carbon atoms, preferably 8 or more carbon atoms, more preferably 10 or more carbon atoms in a hydrocarbon chain and constitute at least 70% by weight, preferably at least 85% by weight, more preferably at least 90% by weight of the total weight of the $C_{6+}$ stream.

"Recycling", as used herein, refers to a process wherein a downstream hydrocarbon fraction, stream and/or product is returned to an upstream process step via a fluid connection.

According to a second aspect, the present disclosure relates to a process for producing an olefin stream from a second hydrotreated gasoline stream and a light pyrolysis oil stream comprising hydrotreating a raw pyrolysis gasoline stream (110) in a hydrotreating unit (102) to form a second hydrotreated pyrolysis gasoline stream (202) and a light pyrolysis oil stream (pyrolysis oil) (201) (see FIG. 2).

The previously described hydrotreating unit (102) may be used to separate a first hydrotreated pyrolysis gasoline stream (107) into a light pyrolysis oil stream (201) and a second hydrotreated pyrolysis gasoline stream (202). The separation of the light pyrolysis oil stream (201) provides an existing oil refinery process the ability to simultaneously produce aromatic products by further processing the second hydrotreated pyrolysis gasoline stream (202), while increasing olefin production using the light pyrolysis oil stream (201) as a feed for the saturating unit (103). In one embodiment, hydrotreating a raw pyrolysis gasoline stream (110) in the hydrotreating unit (102) further comprises dividing a first hydrotreated pyrolysis gasoline stream (107) in the fractionating zone to form the light pyrolysis oil stream (201) and a second hydrotreated pyrolysis gasoline stream (202). In one embodiment the light pyrolysis oil stream (201) is transported to the saturating unit (103) via a fluid connection between the hydrotreating unit (102) and the saturating unit (103).

The second hydrotreated pyrolysis gasoline (202) stream may include at least $C_5$-$C_{10}$ hydrocarbons, preferably $C_6$-$C_9$ hydrocarbons, more preferably $C_6$-$C_8$ hydrocarbons. In one embodiment, the second hydrotreated pyrolysis gasoline stream (202) comprises $C_{6+}$ compounds.

At least one hydrocarbon component of the second hydrotreated pyrolysis gasoline stream (202) may be selected from the group consisting of but not limited to benzene ($C_6$), toluene ($C_7$), xylenes ($C_8$), ethylbenzene ($C_8$), and/or any combination thereof.

Due to a rich aromatic content the second hydrotreated pyrolysis gasoline stream (202) may serve as a feed stream for the production of aromatic products. The aromatic content, preferably the $C_6$-$C_{10}$ aromatic content, of the second hydrotreated pyrolysis gasoline stream (202) may be 5-90% by weight, preferably at least 5%, at least 10%, at least 15%, at least 20%, at least 25%, at least 30%, at least 35%, at least 36%, at least 37%, at least 38%, at least 39%, at least 40%, at least 41%, at least 42%, at least 43%, at least 44%, at least 45%, at least 46%, at least 47%, at least 48%, at least 49%, at least 50%, at least 60%, at least 70%, at least 80%, or at most 90% by weight relative to the second hydrotreated pyrolysis gasoline stream (202).

The light pyrolysis oil stream (201) as used herein refers to an oil fraction of the first hydrotreated pyrolysis gasoline stream that includes aromatic/polyaromatic compounds with at least 8, at least 9, at least 10 carbon atoms, at least one unsaturated carbon to carbon bond, and/or at least one aromatic ring. In one embodiment, the light pyrolysis oil stream (201) comprises $C_{10+}$ compounds having at least one unsaturated carbon to carbon bond and/or an aromatic ring.

The light pyrolysis oil stream (201) may include an aromatic/polyaromatic hydrocarbon content of 10-90% by weight, preferably at least 10%, at least 15%, at least 20%, at least 25%, at least 30%, at least 35%, at least 36%, at least 37%, at least 38%, at least 39%, at least 40%, at least 41%, at least 42%, at least 43%, at least 44%, at least 45, at least 50%, at least 60%, at least 70%, at least 80%, or at most 90% by weight. In one embodiment, the light pyrolysis oil stream (201) comprises by weight at least 40% aromatic compounds, polyaromatic compounds and/or any combination thereof.

Polyaromatic hydrocarbons within the light pyrolysis oil stream (201) may be selected from but are not limited to naphthalene, phenanthrene, anthracene, biphenyl or any combination thereof. In one embodiment, the light pyrolysis oil stream (201) comprises 10-40%, preferably 20-30% naphthalene, 1-10% preferably 4-6% dimethyl benzene, 1-10% preferably 4-6% biphenyl, 1-10%, preferably 4-6% ethyl benzene by weight.

In one embodiment the light pyrolysis oil stream (201) is not subject to transalkylating or dealkylating. Typically, transalkylating/dealkylating steps are used to increase the production of valuable aromatics such as benzene and xylenes by adding, removing and/or rearranging alkyl groups from aromatic $C_{7+}$ components. Eliminating transalkylating/dealkylating steps may provide an increase in olefin production by increasing the $C_{10+}$ aromatic content of the hydrocarbon stream entering a saturating unit (103). This represents a distinct and critical departure from existing refining techniques by emphasizing olefin production over aromatics. In one embodiment the $C_{10+}$ aromatic content of a light pyrolysis oil stream sent to the saturating unit (103) comprises 5-40%, preferably up to 5%, up to 10%, up to 15%, up to 20%, up to 25%, up to 30%, up to 35%, up to 40% $C_{7+}$ aromatic content by weight than a similar light pyrolysis oil stream (201) undergoing transalkylating, dealkylating or both.

The present disclosure also relates to saturating the light pyrolysis oil stream (201) and at least one additional naphtha/hydrocarbon stream (108) in a saturating unit (103) to form a first naphthene stream (106).

The saturating as previously described may not be limited to a single aromatic and/or polyaromatic-rich stream. The additional naphtha/hydrocarbon streams (108) may also be saturated along with the light pyrolysis oil stream (201) to produce the first naphthene stream (106). As a result, the present disclosure could be used to increase olefin stream production relative to the use of the light pyrolysis oil stream (201) by introducing additional naphtha/hydrocarbon streams (108) with varied aromatic/polyaromatic content into the saturating step. A light pyrolysis oil stream (201) and preferably at least two, at least three, or at least four additional naphtha/hydrocarbon streams (108) may be saturated.

In one embodiment, prior to the saturating the light pyrolysis oil stream (201) is processed to saturate one or more dicyclopentadiene compounds present therein producing a DCP deficient light pyrolysis oil stream, a DCP deficient additional naphtha/hydrocarbon stream or both, wherein the unconverted DCP is present in an amount of less than 1.0%, preferably less than 0.5%, more preferably less than 0.1% by weight.

The saturating may convert 10-99%, preferably by weight at least 10%, 20%, at least 30%, at least 40%, at least 50%, at least 55%, at least 60%, at least 65%, at least 70%, at least 75%, at least 80%, at least 81%, at least 82%, at least 83%, at least 84%, at least 85%, at least 86%, at least 87%, at least 88%, at least 89%, at least 90%, at least 91%, at least 92%, at least 93%, at least 94%, at least 95%, at least 96%, at least 97%, at least 98%, or at most 99% of the aromatic components, the polyaromatic components or any combination thereof into naphthenes. In one embodiment, the saturating converts at least 90% of the aromatic rings in the light pyrolysis oil stream (201), the additional naphtha/hydrocarbon stream (108) and/or both into naphthenes.

The use of a dedicated saturating unit (103) provides a way of increasing the naphthenic content for the "low value" light pyrolysis oil stream (201), without sacrificing aromatic production. In one embodiment, the second hydrotreated pyrolysis gasoline stream (202) is sent to a downstream refining process to produce aromatics.

Flowing the first naphthene stream (106) to the steam cracking (101), as it relates to the present disclosure, refers to any process where the first naphthene stream (106) is transported to the steam cracking unit (101) to undergo a pyrolysis reaction to produce an olefin stream. At least 30%, at least 31%, at least 32%, at least 33%, at least 34%, at least 35%, at least 36%, at least 37%, at least 38%, at least 39%, at least 40%, at least 41%, at least 42%, at least 43%, at least 44%, at least 45%, at least 46%, at least 47%, at least 48%, at least 49%, at least 50%, at least 55%, at least 60%, at least 65%, at least 70%, at least 75, at least 80%, at least 85%, at least 90%, or at most 95%, preferably 35-95% by weight of a first naphthene stream's (106) naphthene content may be steam-cracked to form an olefin stream. In one embodiment, at least 40%, by weight of the first naphthene stream (106) is steam-cracked to form an olefin stream.

According to a third aspect, the present disclosure relates to a process for producing an olefin stream from a steam-cracked hydrocarbon stream comprising extracting a first aromatic stream (303) and a raffinate stream (304) in an extraction unit (301) from the second hydrotreated pyrolysis gasoline stream (202) (see FIG. 3).

"Extracting", as used herein, refers to any process wherein at least one hydrocarbon component is separated from a hydrocarbon stream. Extracting methods are well known within the field and by those skilled in the art and may include distillation, solvent extraction, crystallization, adsorption, azeotropic distillation and/or any combination thereof.

The first aromatic stream (303) refers to a hydrocarbon stream where the aromatic content by weight of $C_6$, $C_7$, and/or $C_{8+}$ species is at least 30%, at least 35%, at least 40%, at least 45%, at least 50, at least 55%, at least 60%, at least 65%, or at least 70%, preferably 30-45%. In one embodiment, the first aromatic stream (303) comprises by weight at least 40% aromatic compounds.

The raffinate stream (304) as used herein refers to an aromatically deficient hydrocarbon fraction from the second hydrotreated pyrolysis gasoline stream (202), wherein the aromatics content by weight is less than 3%, less than 2%, less than 1%, less than 0.5% and includes a naphthene content by weight of at least at least 1%, at least 5%, at least 10%, at least 15%, at least 20 at least 25%, at least 30%, at least 35%, at least 40%, or at least 45%, preferably 3-45% by weight. In one embodiment, the aromatic content of the raffinate stream (304) is less than 1%. In another embodiment the naphthene content of the raffinate stream (304) is at least 25%.

Recycling the raffinate stream (304) to the steam cracking refers to a process where the raffinate stream (304) is transported from the extracting (301) to the steam cracking unit (101) via a fluid connection. Subsequently at least 30%, at least 31%, at least 32%, at least 33%, at least 34%, at least 35%, at least 36%, at least 37%, at least 38%, at least 39% at least 40%, at least 45%, at least 50%, at least 55%, at least 60%, at least 65%, or at least 70%, preferably 30-70%, more preferably 30-45%, by weight of the naphthene content of the raffinate stream (304) may be converted to olefins during the steam cracking. In one embodiment, at least 40% of the raffinate stream's (304) naphthene content is converted to olefins.

In the present disclosure, splitting (302) the first aromatic stream (303) to form $C_6$-$C_7$ aromatics streams (305) and (306), and a $C_{8+}$ aromatics stream (308) provides a mechanism for the production of aromatic and/or olefin products within an integrated refinery. The splitting allows for the $C_6$ aromatic stream (305), the $C_7$ aromatic stream (306), a $C_8$ stream (308) and/or any combination thereof to be directed towards aromatic preparation without hindering olefin production from the $C_{8+}$ stream (308). Alternatively, the $C_6$ aromatic stream (305), the $C_7$ aromatic stream (306), the $C_{8+}$ stream (308), and/or any combination thereof maybe directed towards saturation and subsequent olefin production when increased olefin production is preferred over aromatics.

As used herein splitting (302) may refer to any process where a stream may be divided into purified fractions comprising a single hydrocarbon component and/or a hydrocarbon stream having a particular range of volatility, boiling range and/or composition. In one embodiment, the splitting forms a $C_6$ aromatic stream (305), a $C_7$ aromatic stream (305), and a $C_{8+}$ stream (308). The splitting (302) may comprise different methods. An exemplary splitting process is an extractive distillation such as the Sulfolane™ process (UOP) which is well known in the art.

In one embodiment, the aromatic content by weight of the $C_6$ aromatic stream (305), the $C_7$ aromatic stream (306), and/or the $C_{8+}$ stream (308) is at least 10%, at least 11%, at least 12%, at least 13%, at least 14%, at least 15%, at least 16%, at least 17% at least 18%, at least 19%, at least 20%, at least 21%, at least 22%, at least 23%, at least 24%, at least 25%, at least 26%, at least 27%, at least 28%, at least 29%, at least 30%, at least 31%, at least 32%, at least 33%, at least 34%, at least 35%, at least 36%, at least 37%, at least 38%, at least 39%, at least 40%, at least 41%, at least 42%, at least 43%, at least 44%, or at least 45%, preferably 10%-50% by weight of the respective aromatic stream. In one embodiment, the $C_{8+}$ comprises by weight at least 40% aromatic compounds.

The $C_6$ aromatic stream as used herein refers to a benzene rich hydrocarbon distillate with a benzene content range of 30-99% by weight, preferably at least 30%, at least 35%, at least 40%, at least 41%, at least 42%, at least 43%, at least 44%, at least 45%, at least 46%, at least 47%, at least 48%, at least 49%, or at least 50% by weight of the first aromatic stream. In one embodiment a $C_6$ aromatic stream comprises by weight 47% of the first aromatic stream.

The $C_7$ aromatic stream as used herein refers to a toluene rich hydrocarbon distillate with a toluene content range of 15-99% by weight, preferably at least 15%, at least 16%, at least 17%, at least 18%, at least 19%, at least 21%, at least 22%, at least 23%, at least 24%, at least 25%, at least 26%, at least 27%, at least 28%, at least 29%, or at least 30% of the first aromatic stream. In one embodiment a $C_7$ aromatic stream comprises by weight 27% of the first aromatic stream.

The $C_{8+}$ aromatic stream as used herein refers to a heavy aromatic column bottom comprising but not limited to xylenes, ethylbenzene, aromatics containing 9 carbon atoms ($C_{9A}$), aromatics containing 10 or more carbon atoms ($C_{10A+}$), and or any combination thereof.

The $C_{8+}$ aromatic stream may comprise 30-99% by weight, alternately at least 1%, at least 2%, at least 3%, at least 4%, at least 5%, at least 6% by weight xylenes; 30-99% by weight, alternately at least 1%, at least 2%, at least 3%, at least 4%, at least 5%, at least 6% by weight ethyl benzene; 1-99% by weight, alternately at least 0.5%, at least 1%, at least 2%, at least 3%, at least 4%, at least 5%, or at least 6% by weight $C_{9A}$; 1-99% by weight, alternately at least 1%, at least 2%, at least 3%, at least 4% by weight $C_{10A+}$ of the first aromatic stream. In one embodiment a $C_{8+}$ aromatic stream comprises by weight 4% xylenes, 1% ethylbenzene, 4.9% by weight $C_{9A}$, and 3.6% $C_{10A+}$.

The present disclosure includes a process in which a second aromatic stream (307) comprises at least a portion of each of the $C_6$ aromatic stream (305), the $C_7$ aromatic stream (306), the $C_{8+}$ (308) aromatics stream, and/or any combination thereof, the light pyrolysis oil stream (201), and at least a portion of the at least one additional naphtha/hydrocarbon stream (108) to form a first naphthene stream (106).

As previously mentioned, the process output of olefins (104) may be increased by altering the aromatic/polyaromatic hydrocarbon content of the aromatically rich hydrocarbon stream entering the saturating step. The second aromatic stream (307) which may feed directly into the saturating unit (103) may comprise an aromatic compound/polyaromatic hydrocarbon content by weight of 30-99% by weight, preferably at least 30%, at least 31%, at least 32%, at least 33%, at least 34%, at least 35%, at least 36%, at least 37%, at least 38%, at least 39%, at least 40%, at least 41%, at least 42%, at least 43%, at least 44%, at least 45%, at least 46%, at least 47%, at least 48%, at least 49%, at least 50%, at least 51%, at least 52%, at least 53%, at least 54%, at least 55%, at least 56%, at least 57%, at least 58%, at least 59%, at least 60%, at least 61%, at least 62%, at least 63%, at least 64%, at least 65%, at least 66%, at least 67%, at least 68%, at least 69%, or at least 70%. In one embodiment the second aromatic stream (307) comprises by weight at least 50% aromatic compounds, polyaromatic compounds or any combination thereof.

The saturating as previously mentioned may include multiple additional naphtha/hydrocarbon streams (108). The additional naphtha/hydrocarbon streams (108) may be saturated along with the light pyrolysis oil stream (201) to produce the first naphthene stream (106). As a result, olefin stream production may be increased relative to the saturating of the light pyrolysis oil stream (201) by introducing varied aromatic compounds/polyaromatic compounds via the additional naphtha/hydrocarbon streams (108). In one embodiment, the light pyrolysis oil stream (201), and at least two, at least three, at least four additional naphtha/hydrocarbon streams (108) are saturated.

Additional naphtha/hydrocarbon streams (108) may also have varied aromatic compound/polyaromatic compound contents. In one embodiment, the hydrotreated RFCC heavy naphtha stream comprises by weight at least 20% aromatic compounds, polyaromatic compounds, and/or any combination thereof. In one embodiment, the hydrocracked LCO naphtha comprises at least 25% aromatic compounds, polyaromatic compounds and/or any combination thereof.

Aromatic/polyaromatic content within the additional naphtha/hydrocarbon stream (108) may be at least 15% by weight, at least 20%, at least 25%, at least 30%, at least 35%, at least 40%, at least 45%, at least 50%, at least 55%, or at least 60% by weight of the total additional naphtha/hydrocarbon stream (108).

In one embodiment, a portion of the second aromatic stream (307), a portion of the light pyrolysis oil stream (201), a portion of the at least one additional naphtha/hydrocarbon stream (108), and/or any combination thereof, are subject to transalkylating, dealkylating, isomerizing, and/or any combination thereof. The portions of the second aromatic stream (307), the portions of the light pyrolysis oil stream (201), the portion of the at least one additional naphtha/hydrocarbon stream (108), and/or any combination thereof, are subject to processing conditions that result in transalkylating/dealkylating in no more than 5% by weight of the aromatic compounds, preferably no more than 1.0%, 0.5% or 0.1% by weight.

In one embodiment, prior to the saturating, the light pyrolysis oil stream (201), the second aromatic stream (307), the at least one additional naphtha/hydrocarbon stream (108), and/or any combination thereof are processed to saturate one or more dicyclopentadiene compounds present therein.

In one embodiment, the at least one additional naphtha/hydrocarbon stream (108), the second aromatic stream (307), the light pyrolysis oil stream (201) and/or any combination thereof, include a DCP content by weight that is less than 1.0%, preferably less than 0.5%, more preferably less than 0.1%. DCP may be recovered as product for further refinement.

The saturating may convert by weight 30-95%, preferably at least 30%, at least 40%, at least 50%, at least 60%, at least 70, at least 75%, at least 80%, at least 81%, at least 82%, at least 83%, at least 84%, at least 85%, at least 86%, at least 87%, at least 88%, at least 89%, at least 90%, at least 91%, at least 92%, at least 93%, at least 94%, or at most 95% of the aromatic components, the polyaromatic components or any combination thereof into naphthenes. In one embodiment, the saturating converts at least 90% of the aromatic rings in the stream of at least a portion of each of the $C_6$ aromatic stream (305), the $C_7$ aromatic stream (306), the $C_{8+}$ aromatics stream (308), the light pyrolysis oil stream (201), the at least one additional naphtha/hydrocarbon stream (108), and/or any combination thereof to form naphthenes. The first naphthene stream (106) could be a feedstock that is steam-cracked to produce the olefin stream. As a result, the naphthene content in the first naphthene stream (106) is an important quantity for determining olefin production. The first naphthene stream (106) may include a naphthene content of at least 60%, at least 65%, at least 70%, at least 75%, least 80%, at least 85%, at least 90%, at most 95%, preferably 60-95% by weight. In one embodiment, the first naphthene stream (106) comprises by weight at least 60% aromatic compounds.

According to a fourth aspect, the present disclosure provides a process for producing an olefin stream and a light pyrolysis oil stream (201) comprising hydrotreating the raw pyrolysis gasoline stream in a hydrotreating unit (102) to form a second hydrotreated pyrolysis gasoline stream (202) and a light pyrolysis oil stream (201). The first aromatic stream is split to form a $C_6$ stream, a $C_7$ stream, a $C_8$ xylene stream, a $C_8$ ethyl benzene rich stream, and a $C_{9+}$ aromatics stream.

As previously discussed the light pyrolysis oil stream (201) represents an excellent feedstock for increasing olefin production when coupled with saturating and steam cracking. However, a desire to use the light pyrolysis oil stream (201) as a fuel oil additive does not need to be sacrificed to achieve increased olefin production. In cases where fuel oil additives production, aromatic production and increased olefin production are desired, the light pyrolysis oil stream (201) may be sent to a fuel oil pool for use as a fuel additive while the raffinate stream (304), the second aromatic stream (307), additional hydrocarbon/naphtha stream (108) and/or any combination thereof may be processed as previously discussed to produce aromatic, and/or olefin products.

The light pyrolysis oil stream (201) is separated and may include an aromatic/polyaromatic hydrocarbon content of 5-99% by weight, preferably at least 5%, at least 6%, at least 7%, at least 8%, at least 9%, at least 10%, at least 15%, at least 20%, at least 25%, at least 30%, at least 35%, at least 36%, at least 37%, at least 38%, at least 39%, at least 40%, at least 41%, at least 42%, at least 43%, at least 44%, at least 45%, at least 46%, at least 47%, at least 48%, at least 49%, at least 50%, at least 55%, at least 60%, at least 65%, at least 70%, at least 75%, at least 80%, at least 85%, at least 90%, or at least 95% by weight. In one embodiment, the light pyrolysis oil stream (201) comprises by weight at least 40% aromatic compounds, polyaromatic compounds and/or any combination thereof.

The $C_{9+}$ aromatic stream as used herein refers to a heavy aromatic column bottom comprising but not limited to aromatics containing 9 carbon atoms or more ($C_{9A}$), aromatics containing 10 or more carbon atoms ($C_{10A+}$), and or any combination thereof.

The $C_{9+}$ aromatic stream may comprise 30-99% by weight, alternately at least 1%, at least 2%, at least 3%, at least 4%, at least 5%, at least 6% by weight $C_{9A}$; 1-99% by weight, alternately at least 1%, at least 2%, at least 3%, at least 4% by weight $C_{10A+}$ of the first aromatic stream. In one embodiment a $C_{9+}$ aromatic stream comprises by weight 4.9% by weight $C_{9A}$, and 3.6% $C_{10A+}$.

The present disclosure also refers to saturating an aromatically rich hydrocarbon stream comprising, a second aromatic stream (307) comprising, at least a portion of each of the $C_6$ stream (305), the $C_7$ stream (306), the $C_8$ xylene stream (309), the $C_8$ ethyl benzene rich stream (310), the $C_{9+}$ aromatics stream (311), and/or any combination thereof, and at least a portion of the at least one additional naphtha/hydrocarbon stream (108) to form a first naphthene stream (106).

As previously mentioned, the process output of olefins may be increased by altering the aromatic/polyaromatic hydrocarbon content of aromatically rich hydrocarbon streams entering the saturating unit (103). The second aromatic stream (307) which may feed directly into the saturating may comprise an aromatic compound/polyaromatic hydrocarbon content by weight of at least 30%, at least 40%, at least 41%, at least 42%, at least 43%, at least 44%, at least 45%, at least 46%, at least 47%, at least 48%, at least 49%, at least 50%, at least 51%, at least 52%, at least 53%, at least 54%, at least 55%, at least 56%, at least 57%, at least 58%, at least 59%, at least 60%, at least 65%, or at most 70%, preferably 30-70%. In one embodiment, the second aromatic stream (307) comprises by weight at least 50% aromatic compounds, polyaromatic compounds or any combination thereof.

The saturating may convert at least 10%, at least 20%, at least 25%, at least 30%, at least 35%, at least 40% at least 45%, at least 50%, at least 55%, at least 60%, at least 65%, at least 70%, at least 75%, at least 80%, at least 81%, at least 82%, at least 83%, at least 84%, at least 85%, at least 86%, at least 87%, at least 88%, at least 89%, at least 90%, at least 91%, at least 92%, at least 93%, at least 94%, or at most 95%, preferably 10-95%, more preferably 80-95% by weight of the aromatic components (based on the total weight of the feedstock material subject to the saturating), the polyaromatic components or any combination thereof into naphthenes. In one embodiment, the saturating converts at least 90% of the aromatic rings in the stream of at least a portion of each of the $C_6$ aromatic stream (305), the $C_7$ aromatic stream (306), the $C_{8+}$ aromatic stream (308), the at least one additional naphtha/hydrocarbon stream (108), and/or any combination thereof to form naphthenes.

The resulting first naphthene stream is subject to the previously disclosed saturating, and steam cracking procedures to produce an olefin stream.

The invention claimed is:

1. A process for producing an olefin stream from a steam-cracked hydrocarbon stream, the process consisting of the steps of:

steam cracking a naphtha rich stream to form a steam-cracked hydrocarbon stream and a heavy pyrolysis oil stream;

separating the steam-cracked hydrocarbon stream to form an olefin rich stream and a raw pyrolysis gasoline stream, wherein the raw pyrolysis gasoline stream comprises aromatic hydrocarbons;

hydrotreating the raw pyrolysis gasoline stream with hydrogen in a hydrotreating unit to hydrogenate the aromatic hydrocarbons in the raw pyrolysis gasoline stream and to and remove any nitrogen and/or sulfur containing species from the raw pyrolysis gasoline stream to form a first hydrotreated pyrolysis gasoline stream and a light pyrolysis oil stream;

feeding the first hydrotreated pyrolysis gasoline stream to a saturating unit and mixing with at least one additional naphtha hydrocarbon stream to form a mixed stream and saturating the mixed stream with a hydrogen gas stream to produce a first naphthene stream; and flowing the first naphthene stream back to the steam cracking to produce olefins.

2. A process for producing an olefin stream from a steam-cracked hydrocarbon stream, the process consisting of steps of:

steam cracking a hydrocarbon stream to form a steam-cracked hydrocarbon stream and a heavy pyrolysis oil stream, wherein the steam-cracked hydrocarbon stream consists of butadiene, ethylene and propylene;

separating the steam-cracked hydrocarbon stream in a separation zone to form a raw pyrolysis gasoline stream and an olefin rich stream;

preheating the raw pyrolysis gasoline stream in a preheating zone to a temperature of at least 50° C.;

mixing the preheated raw pyrolysis gasoline with a preheated hydrogen gas flow to form a hydrogen/raw pyrolysis gasoline stream within a pressure consisting of 490 psig;

contacting the hydrogen/raw pyrolysis gasoline stream with a first hydrotreatment catalyst in a first stage of a hydrotreatment reactor to hydrogenate polyaromatic components at a temperature consisting of 50° C. and a reaction pressure consisting of 490 psig, wherein the hydrotreating catalyst consists of iridium attached to a silica-alumina support;

contacting the hydrotreated hydrogen/raw pyrolysis gasoline with a cold hydrogen gas stream in a quenching zone to lower a hydrogen/raw pyrolysis gasoline temperature;

reacting the hydrotreated hydrogen/raw pyrolysis gasoline from the first hydrotreatment stage with a second hydrotreatment catalyst in a second stage to convert components containing sulfur, nitrogen and metals into sulfides, ammonia, and metal sulfides, respectively, at a temperature consisting of 170° C. and a reaction pressure consisting of 490 psig;

removing the sulfides, the ammonia, the metal sulfides, and any excess hydrogen in the separating zone to produce a hydrotreated pyrolysis gasoline stream at a temperature consisting of 60° C. and a reaction pressure consisting of 450 psig; and dividing the hydrotreated pyrolysis gasoline stream in the fractionating zone to produce a first hydrotreated pyrolysis gasoline stream containing a light pyrolysis oil stream wherein the operating conditions of the fractionating zone include a temperature consisting of 40° C. and a pressure consisting of about 0.7 psig;

wherein the hydrotreating unit consists of two hydrotreating reactors with 30 hydrotreating catalyst beds each separated by a quenching zone;

wherein the light pyrolysis oil stream consists of $C10^+$ compounds having at least one an aromatic ring;

wherein the light pyrolysis oil stream consists of $C10^+$ compounds having at least one an aromatic ring, and the second hydrotreated pyrolysis gasoline stream consists of C5 compounds having at least one unsaturated carbon to carbon bond and an aromatic ring; and wherein the second hydrotreated pyrolysis gasoline stream consists of $C_5$-$C_9$ compounds having at least one unsaturated carbon to carbon bond and/or an aromatic ring.

3. The process of claim 1, wherein the first aromatic stream comprises 30-80% by weight of aromatic compounds.

4. The process of claim 1, wherein the splitting forms a $C_6$ aromatic stream comprising mainly $C_6$ aromatic hydrocarbons, a $C_7$ aromatic stream comprising mainly $C_7$ aromatic hydrocarbons, and a $C_{8+}$ stream comprising mainly $C_{8+}$ aromatic hydrocarbons.

5. The process of claim 1, wherein the $C_{8+}$ aromatics stream comprises by weight at least 40% aromatic compounds.

6. The process of claim 1, wherein the splitting forms a C8+ stream comprising mainly C8+ aromatic hydrocarbons.

7. The process of claim 1, wherein the splitting forms a C7 aromatic stream comprising mainly C7 aromatic hydrocarbons and a C8+ stream comprising mainly C8+ aromatic hydrocarbons.

8. The process of claim 1, wherein the splitting forms a C6 aromatic stream comprising mainly C6 aromatic hydrocarbons.

9. A process for producing an olefin stream from a steam-cracked hydrocarbon stream, comprising:

steam cracking a hydrocarbon stream to form a steam-cracked hydrocarbon stream and a heavy pyrolysis oil stream, wherein the steam-cracked hydrocarbon stream comprises at least one of butadiene, ethylene, propylene, and/or any combinations thereof;

separating the steam-cracked hydrocarbon stream to form an olefin rich stream and a raw pyrolysis gasoline stream comprising aromatic compounds;

hydrotreating the raw pyrolysis gasoline stream with hydrogen in a hydrotreating unit to hydrogenate the aromatic hydrocarbons in the raw pyrolysis gasoline stream and to and remove any nitrogen and/or sulfur containing species from the raw pyrolysis gasoline stream to form a first hydrotreated pyrolysis gasoline stream and a light pyrolysis oil stream;

saturating the first hydrotreated pyrolysis gasoline stream together with at least one additional naphtha/hydrocarbon stream to form a first naphthene stream; and flowing the first naphthene stream to the steam cracking to form olefins.

* * * * *